US011094235B2

(12) United States Patent
De Castro Turner et al.

(10) Patent No.: US 11,094,235 B2
(45) Date of Patent: Aug. 17, 2021

(54) VEHICLE BODYWORK DISPLAY SCREEN

(71) Applicant: Silverstone Design Limited, Northamptonshire (GB)

(72) Inventors: Robert Rodrigues De Castro Turner, Northamptonshire (GB); Mark Antony Castro Turner, Northamptonshire (GB)

(73) Assignee: Silverstone Design Limited, Northamptonshire (GB)

( * ) Notice: Subject to any disclaimer, the term of this patent is extended or adjusted under 35 U.S.C. 154(b) by 0 days.

(21) Appl. No.: 17/133,371

(22) Filed: Dec. 23, 2020

(65) Prior Publication Data

US 2021/0118341 A1 Apr. 22, 2021

Related U.S. Application Data

(63) Continuation-in-part of application No. 17/255,767, filed as application No. PCT/GB2019/000091 on Jun. 28, 2019.

(51) Int. Cl.
*G09G 3/00* (2006.01)
*G09F 21/04* (2006.01)
(Continued)

(52) U.S. Cl.
CPC ..... *G09F 21/048* (2013.01); *G09F 9/301* (2013.01); *G09F 21/023* (2020.05); *G09G 3/035* (2020.08);
(Continued)

(58) Field of Classification Search
CPC ..... G09G 2354/00
See application file for complete search history.

(56) References Cited

U.S. PATENT DOCUMENTS 9,791,694 B1 * 10/2017 Haverkamp ..... G06F 3/013
9,873,037 B2 1/2018 Hamilton
(Continued)

FOREIGN PATENT DOCUMENTS

CN 203093951 U 7/2013
DE 102005034771 A1 5/2006
(Continued)

OTHER PUBLICATIONS

International Search Report in PCT Application No. PCT/GB2019/000091, dated Apr. 29, 2020.

*Primary Examiner* — Nan-Ying Yang
(74) *Attorney, Agent, or Firm* — Cognition IP, P.C.; Edward Steakley

(57) ABSTRACT

A bodywork panel for a vehicle such as a racing car or a racing motorcycle is fitted with one or more optically clear panels, which are profiled to follow the aerodynamic form of the bodywork panel. A flexible reflective display screen, for examples based on e-paper, is mounted to an inner face of each optically clear panel such that an image on the display screen is visible outside the vehicle through the optically clear panel. A paint finish on the bodywork panel continues over a peripheral region of each optically clear panel, concealing a join between it and the bodywork panel. Images displayed on the display screens via a display controller can thus appear like painted graphics on the bodywork panel, except that they may be changed as desired. Thus, graphics on the vehicle, such as advertising and sponsorship logos, can be changed at will during a race. Leathers worn by racing motor cyclists can be fitted with similar display screens mounted behind optically clear flexible plastic panels sewn to the leathers.

20 Claims, 30 Drawing Sheets

(51) Int. Cl.

| | |
|---|---|
| ***G09F 9/30*** | (2006.01) |
| ***G09F 21/02*** | (2006.01) |
| *A41D 1/00* | (2018.01) |
| *G09G 3/34* | (2006.01) |

(52) U.S. Cl.
CPC ..... *A41D 1/002* (2013.01); *G09G 3/3453* (2013.01); *G09G 2370/022* (2013.01); *G09G 2370/16* (2013.01); *G09G 2380/02* (2013.01); *G09G 2380/10* (2013.01)

(56) References Cited

U.S. PATENT DOCUMENTS

| | | | | |
|---|---|---|---|---|
| 2007/0019424 | A1 | 1/2007 | Alexander | |
| 2012/0137399 | A1 | 6/2012 | Forte et al. | |
| 2014/0114502 | A1* | 4/2014 | Hugron | G07C 5/008 701/2 |
| 2014/0160643 | A1* | 6/2014 | Gerstner | H05K 5/0017 361/679.01 |
| 2016/0041581 | A1 | 2/2016 | Piccionelli et al. | |
| 2016/0295715 | A1* | 10/2016 | Cho | B32B 3/263 |

FOREIGN PATENT DOCUMENTS

| | | | |
|---|---|---|---|
| DE | 102010034062 | A1 | 2/2012 |
| DE | 20 2013 103405 | U1 | 11/2014 |
| KR | 20150122042 | A | 10/2015 |
| WO | 2005/020731 | A1 | 3/2005 |
| WO | 2017/180900 | A1 | 10/2017 |

* cited by examiner

VEHICLE BODYWORK DISPLAY SCREEN

CROSS-REFERENCE TO RELATED APPLICATIONS

This application is a continuation-in-part of U.S. application Ser. No. 17/255,767, filed Dec. 23, 2020, which is a 35 U.S.C. § 371 national stage application of PCT International Application No. PCT/GB2019/000091, filed on Jun. 28, 2019, which claims the benefit of Great Britain Application No. 1810799.5, filed Jun. 29, 2018 and Great Britain Application No. 1817103.3, filed Oct. 19, 2018. This application also claims the benefit of Great Britain Application No. 1919392.9, filed on Dec. 28, 2019 and Great Britain Application No. 2020293.3, filed Dec. 21, 2020. The contents of the above patent applications are hereby incorporated by reference in their entirety.

The present invention relates to a display screen mounted to a vehicle, to its method of manufacture and to its method of use. More particularly but not exclusively, it relates to a display screen integrated into bodywork of a car, especially a racing car.

In the field of racing cars, whether Formula 1, Indycar, Le Mans or other types of racing, the bodywork of the car has two significant roles. The carefully-designed curvature of the bodywork provides an aerodynamic surface to optimise airflow over the car, reducing drag and providing aerodynamic downforce to hold the car to the track. Additionally, in the highly commercial area of motor sport, the bodywork provides advertising space to show sponsors' names and/or logos to best effect. For many types of racing car, these are the main roles of the bodywork, with structural loads being taken up by an internal chassis, mainly concealed within the bodywork.

For many classes of racing car, the bodywork contributes little to absorbing structural loads, these being taken up by an internal chassis, which is largely enclosed within the aerodynamic bodywork shell.

Race car construction falls broadly into two main categories. One category of race car is mostly derived from production motor cars, which generally have a unitary metal construction to which additional components are bolted, usually including a supplementary internal roll cage for additional driver protection. Even so, many metal body panels may usefully be replaced with lighter panels of composite material, having substantially the same shape. This category will be referred to herein as the "GT car" category.

The other main category makes extensive use of custom-built carbon fibre composite materials, usually consisting of a strong and relatively heavy chassis of carbon fibre composites and aluminium honeycomb, to which the engine and suspension/wheels are mounted, with lightweight body panels of carbon fibre composite and polymer honeycomb being bolted around the chassis to create the aerodynamic bodywork and to provide an aesthetic outer surface to bear the team colours and sponsor logos, etc. This category will be referred to herein as the "Formula Car" category.

Other classes are designed and produced from scratch, and generally comprise a strong and (relatively) heavy chassis of carbon fibre composites and a honeycomb core, to which the engine, suspension, wheels, floor and wings are mounted, with lightweight body panels of carbon fibre composite and polymer honeycomb being mounted to the chassis to form an aerodynamic bodywork. This bodywork then also provides an aesthetic outer surface to display team colours, sponsors' logos and the like (as can visible portions of the other vehicle components listed above). Although this category also includes the "Indy car" type, it will be referred to herein, for convenience, as the "Formula car" category.

Popular examples of GT Cars include Nascar and International Touring Car, while popular examples of Formula Cars include Formula 1, Indycar and Le Mans Prototype (LMP). For some time now, Formula 1 has been considered to be the pinnacle of Formula Car racing, with much cutting-edge automotive technology being developed in Formula 1, before trickling down to other racing car categories, and often (eventually) to mass-production motor vehicles. (Note: Formula 1 is a registered trade mark of Formula One Licensing BV; Indycar is a registered trade mark of Brickyard Trademarks, Inc; Nascar is a registered trade mark of National Association for Stock Car Auto Racing, Inc).

Weight reduction plays a crucial part in the Formula Car category, with the result that the outer body panels are usually constructed from two very thin plies of carbon fibre composite sandwiching a core of honeycomb Nomex sheet or the like (Nomex is a registered trade mark of EI Du Pont for its meta-aramid flame-resistant woven and non-woven materials). The bodywork panels are hence very light but relatively stiff, and since they only have to cope with aerodynamic loads not major structural loads, this is sufficient. However, they are susceptible to damage from other causes. The panels are particularly prone to puncture and abrasion damage, as well as delamination. The body panels are also vulnerable to damage during maintenance, for example during paint refinishing and replacement of bodywork graphics.

For example, the force required to pull a vinyl graphic off the bodywork can be such that the outer ply of carbon fibre delaminates from the honeycomb core. Removing old paint for refinishing a bodywork panel generally involves scraping with a bladed tool. This can breach the outer surface of the carbon fibre ply, greatly weakening it and possibly leading to delamination of the carbon fibre ply from the honeycomb core during a race. The painting process also includes a sanding step for removing old paint and for preparing the surface to apply a new primer, and it is all too easy to sand through into the carbon fibre ply below.

Repair of such damage usually requires the application of additional layers of carbon fibre over the damage, or the use of structural adhesives and fillers to bond the damaged areas back together. Further filler will also be needed to restore the shape of the bodywork panel. All of these repairs add weight to the panel, which is to be avoided, either to maximise power to weight ratios, or to allow more of a rules-defined weight limit to be used on performance-enhancing components.

A further issue for motor racing teams is to keep down costs. Formula 1 teams, for example, usually travel directly from one track to the next during the season, rarely returning to their base of operations. Damaged bodywork may well require separate return to the base of operations for repair or refinishing in addition to normal logistic requirements. If a painted graphic on a bodywork panel is to be changed between races, e.g. due to new sponsorship deals, then the panel would again have to be returned to base to be modified and sent on to meet the team at its next event. Additional body panels will need to be carried, in case those being repaired or refinished are not ready in time or cannot be repaired. Thus, many different additional costs will occur as a result of the need to refinish panels or to change panels finishes voluntarily.

Yet another issue is time management. At many events, such as Formula 1 Grands Prix, limited amounts of time are available to work on the car. Time spent on processing bodywork repairs is time not spent on more fundamental issues. It is possible that bodywork panels and the like may not be available at convenient times, requiring unscheduled transportation or simply not being available for a race, due to insufficient time between events.

The business models of most motor racing teams are heavily dependent on sponsorship and hence on graphics on the cars to display this sponsorship. It is similarly essential to display the team's own branding on the cars. Advertising revenue will be dependent on showing relevant marks and graphics to best effect, and as responsively as possible to any changes. Voluntary changes in graphics are hence just as important as remedial work.

The application of graphics such as logos to race cars is currently carried out by two main methods, painting them on or applying pre-formed "graphics" of self-adhesive vinyl sheet.

Painted graphics give a very good visual finish, but disadvantages include the time taken to paint a design on to a bodywork panel; that complicated designs are difficult to apply and some have been found impossible to paint; and changing a graphic requires repainting. Overpainting is unacceptable, for example on weight grounds, and the old design has been known to show through the new one on top. Stripping off an old painted design produces a significant time delay before the new design can be applied. In any case, stripping the old paint causes wear and tear on the relatively fragile body panels. This can lead to more delay for repairing the wear and tear—which then adds to the weight of the panel anyway. Also, complex repainting requires specialist facilities not available at the race track, so panels have to be sent away, wasting time and increasing costs.

Thus, changing painted graphics has weight, cost and time implications. In extreme cases, these constraints may make it preferable to buy or produce extra bodywork parts for painting with different graphics. Ultimately, if an advertiser changes, and it is not possible to display the new advertising at the next race, the new advertiser will not pay and the old advertiser will benefit from free publicity.

Self-adhesive vinyl graphics have the benefit of rapid application and removal, but also have several disadvantages. A vinyl graphic has a significant thickness, causing a step on the surface of the bodywork. Such a step can be sufficient to interfere with smooth airflow across the surface of the bodywork, having an appreciable adverse effect on the aerodynamics of the race car. Such steps are frequently visible, producing a poor visual aesthetic. Close up to the car, the steps can be felt if a hand is run across the panel.

As referred to above, the removal of a vinyl graphic causes stresses in the underlying substrate, which can cause the underlying paint finish to peel off. Thus, stripping and repainting will be needed, which themselves can result in wear and tear on the bodywork, leading to repairs, which add weight. The stress of peeling off a vinyl graphic can even lead to delamination of the structure of the bodywork panel itself, again requiring repair and added weight, or even replacement.

Application of a vinyl graphic has a finite chance of trapping air bubbles beneath the vinyl sheet, leading to an inferior visual aesthetic, or the need to peel off and reapply the graphic. This naturally runs a further risk of peeling off the paint or delaminating the layered bodywork structure.

In any case, vinyl graphics cannot be made with the high gloss levels of automotive paintwork, and are less smooth on a visible scale, both effects making the vinyl graphics stand out visually from the painted bodywork, making them appear low quality and aesthetically compromised.

Thus, the use of vinyl graphics also has weight, cost and time implications, largely arising from the real chance of damage to paint and bodywork laminates during removal. This leads to the same set of problems as for painted graphics, ultimately leading to the choice of having to procure more spare bodywork panels or being unable to change a graphic in time for the next race.

The need to change bodywork logos and other graphics so often stems from current methods for arranging advertising on race cars. While major teams usually have major sponsors and advertisers able to pay for a space on a car for a complete season of races, minor teams tend to rely more on a larger number of smaller advertisers, many of which will only be able to afford to rent space on the car for a few races. There is hence a need for frequent changes of graphics, every time one of the advertisers changes.

As shown above, it is difficult to change the graphics quickly and any changes can lead to bodywork damage. It is hence preferable to try to book advertising to appear over many races, and the most visible (and hence valuable) locations on the bodywork would ideally be committed to one advertiser/sponsor. This allows little commercial flexibility and it is hard to earn as much as if multiple advertisements could be shown. It would also tend to restrict advertising to multi-national companies, rather than allowing an advertiser to buy space on the bodywork for only its "home" Grand Prix, for example.

Ideally, one might want to show several alternative advertisements during the same race, especially for the minor teams that are unable to attract the "high value" sponsors. However, current application methods require physical contact for a significant time. In a Formula 1 Grand Prix under 2018 rules, cars stop in the pits to change tyres once or twice a race, typically for a few seconds at a time, so no graphic changes are possible—even a few more seconds stopped to replace damaged bodywork can be enough to ruin a driver's chances in a race, so extra time to change graphics would not be possible.

Nevertheless, if it were to be possible to sell advertising in blocks of a few laps, rather than a few races, then the overall value of the advertising space would rise. The economics of advertising (in cases where changes are simple and low cost) almost always shows that for example a dozen five minute slots competed over by multiple advertisers are more valuable than a single slot one hour long that fewer could afford anyway.

Since there can be visible portions of the chassis, floor pan, wings and so forth on which logos can currently be displayed, it is hence desirable that an improved invention for body panels in the stricter sense should also be usable on these other components. Therefore, for the purposes of the present application, the terms "bodywork element" and "bodywork panel" should be defined to include the chassis, floor pan, nose cone, wings, wheels, engine, suspension and any other structural or non-structural portion of the car.

It is hence an object of the present invention to provide apparatus for displaying such graphics on bodywork of a vehicle such as a race car, that obviates the above disadvantages of existing approaches and allows graphics to be changed responsively, rapidly, effectively, economically, and without risking the integrity of the bodywork panels at every change, while also being convenient and economical to produce. It is also an object of the present invention to provide a method for manufacturing such apparatus. It is a further aspect of the present invention to provide an improved method of arranging the sale and presentation of advertising space on a vehicle, using such apparatus.

It is a further object of the present invention to allow repair and replacement of the apparatus, on site, rapidly and without specialist equipment.

According to a first aspect of the present invention, there is provided a bodywork element for a vehicle, adapted for the external display of controllably selectable images, comprising a bodywork panel having an aperture formed therein, a inset panel of optically clear plastics material filling said aperture, with an outer surface of the inset panel extending flush with an outer surface of the bodywork panel and being formed to continue a surface profile of the bodywork panel, and flexible display screen means mounted to an inner face of the inset panel so as to be visible through the inset panel, the display screen means being operatively connected or connectable to control means for the display screen means, said control means being adapted to control the display screen means to display a selected image.

Preferably, a volume defined between an inner surface of the inset panel and an adjacent display surface of the display screen means is filled with an optically clear solid, liquid or gel material.

Advantageously, the display screen means is mounted to the inner surface of the inset panel by means of a continuous, void-filling layer of optically clear adhesive.

Preferably, a filler material is inserted along a join between an inner circumference of the aperture in the bodywork panel and an outer circumference of the inset panel, so as to fill any gaps between the bodywork panel and the inset panel.

The filler material may also be shaped to blend together a surface profile of the bodywork panel and a surface profile of the inset panel.

Advantageously, the bodywork panel is coated with a conventional paint finish, which is feathered over a marginal zone of the inset panel, camouflaging the join and an outer rim of the display screen means beneath the inset panel.

Advantageously, the bodywork panel may instead be coated with a conventional paint finish extending across a marginal zone of the inset panel to camouflage the join, wherein a shape of the inset panel and a shape of an inner edge of the conventional paint finish are substantially different, thus obscuring the shape of the inset panel and a shape of the display screen means beneath the inset panel.

Preferably, the aperture in the bodywork panel is formed with a rebate on an outer surface thereof, extending around the circumference of the aperture.

Advantageously, the inset panel is then profiled around its circumference to conform to said rebate, optionally so as to form an interference fit therewith.

In a preferred embodiment of this aspect, the inset panel is mounted permanently to the bodywork panel.

In an alternative embodiment of this aspect, the inset panel is releasably mounted to the bodywork panel.

In either said embodiment, the display screen means may be mounted permanently to the inset panel.

Alternatively, the display screen means may be selectably detachable from the inset panel.

Preferably, the control means comprises part of the bodywork element and is mounted thereto.

Alternatively, the control means is mounted to the vehicle away from the bodywork element, with a detachably wired or wireless operative connection between the control means and the display screen means.

Preferably, the control means is wirelessly operatively connectable to remote server means, by which image data and/or display instructions may be transmitted to the control means.

Thus, an operator using the remote server means may transmit instructions and optionally new image data regarding a particular image to the control means, which will in turn control the display screen means to display said image.

Alternatively, or additionally, the control means may be programmed to change between images displayed at pre-selected times, without external instructions.

Alternatively or additionally, the control means may be linked to sensor means on the vehicle, providing data including vehicle speed and location, and the control means is then programed to change images displayed in response to signals received from said sensor means.

Thus, a particular pre-selected image may be displayed when the vehicle is in the pit lane and stopped in the pits, for example.

In a preferred embodiment, the bodywork element has a plurality of apertures formed therein, each aperture being filled by a corresponding inset panel and having a respective display screen means mounted to the inner face of each inset panel.

The plurality of display screen means may each be operatively connected or connectable to a respective control means.

Alternatively, the plurality of display screen means may be operatively connected or connectable to a single control means.

According to a second aspect of the present invention, there is provided a method for producing a bodywork element for a vehicle, adapted for the external display of controllably changeable images, comprising the steps of:

providing a bodywork panel having an aperture formed therein, providing an inset panel of optically clear plastics material shaped to fit said aperture and formed to match a surface profile of the bodywork panel;

fitting said inset panel into said aperture;

providing flexible display screen means;

mounting the flexible display screen means to an inner face of the inset panel so as to be visible through the inset panel; and arranging an operative connection between the flexible display screen means and control means for the display screen means, said control means being adapted to control the display screen means to display a selected image.

Preferably, the control means is mounted to the bodywork element.

Advantageously, the control means is adapted to receive image data and instructions from a remote server means, optionally by radio.

Preferably, the method comprises the step of filling any volume extending between the inner surface of the inset panel and a display surface of the display screen means with an optically-clear solid, liquid or gel material.

Advantageously, the display screen means is mounted to the inner surface of the display screen means by means of a continuous, void-filling layer of optically-clear adhesive.

Preferably, said bodywork element comprises a bodywork element as described in the first aspect above.

According to a third aspect of the present invention, there is provided a method for arranging the display of advertising images on a vehicle, comprising the steps of:

providing a vehicle and at least one bodywork element for the vehicle as described in the first aspect above;

mounting said at least one bodywork element to the vehicle;

providing at least one set of instructions to generate an advertising image on display screen means of a bodywork element;

storing said at least one set of instructions on control means operatively connected to display screen means of the bodywork element, or on server means remotely operatively connected to said control means;

agreeing conditions under which a particular advertising image is to be displayed; and under said conditions causing the control means to pass a particular set of instructions to the display screen means such that it displays said particular image.

Preferably, said conditions comprise specified periods of time, e.g. during a race.

Advantageously, said conditions comprise specified vehicle locations, vehicle speeds or the like.

According to a fourth aspect of the present invention, there is provided a piece of protective equipment for a rider or driver of a vehicle, adapted for the external display of controllably selectable images, comprising a panel of optically clear plastics material and flexible display screen means mounted to an inner face of the optically clear panel so as to be visible through the optically clear panel, the optically clear panel being mounted or mountable to the piece of protective equipment and the flexible display screen means being operatively connected or connectable to control means for the display screen means, said control means being adapted to control the display screen means to display a selected image.

Preferably, said display screen means comprises reflective display screen means.

Preferably, said piece of protective equipment comprises a piece of protective clothing.

Advantageously, said piece of protective clothing comprises a protective bodysuit or "leathers" for wear by a rider of a racing motorcycle.

Preferably, the panel of optically clear material comprises a flexible optically clear material.

The panel of optically clear material may then be sewn to the protective equipment, optionally being sewn to a flexible zone of a piece of protective clothing.

The panel may alternatively be sewn to the protective equipment behind an aperture formed in an outer layer of the protective equipment.

Alternatively, the panel of optically-clear material comprises a rigid optically clear material.

The panel of optically clear material may then be fastened to a rigid zone of a piece of protective clothing, optionally being shaped to conform to a surface profile of said rigid zone.

According to a fifth aspect of the present invention, there is provided a bodywork element for a vehicle, adapted for the external display of controllably selectable images, comprising a bodywork panel having an aperture formed therein, a inset panel of optically clear plastics material filling said aperture, with an outer surface of the inset panel extending flush with an outer surface of the bodywork panel and being formed to continue a surface profile of the bodywork panel, and reflective display screen means mounted to an inner face of the inset panel so as to be visible through the inset panel, the display screen means being operatively connected or connectable to control means for the display screen means, said control means being adapted to control the display screen means to display a selected image.

According to a sixth aspect of the present invention, there is provided a bodywork element for a vehicle, adapted for the external display of controllably selectable images, comprising a bodywork panel having a shallow recess formed therein, a floor of said recess substantially matching a profile of an outer surface of the bodywork panel, and a display screen module comprising flexible reflective display screen means mounted beneath (for example mounted to) a first layer of optically clear plastics material, and optionally between the first layer and a second layer of protective plastics material so as to be visible through said first layer, wherein the display screen module is held conformably within the shallow recess, optionally with the second layer of protective plastics material extending in contact with the floor of the recess, and the first layer of optically clear plastics material extending flush with the outer surface of the bodywork panel and continuing a surface profile of the bodywork panel, and wherein the display screen means is operatively connected or connectable to control means therefor, said control means being adapted to control the display screen means to display a selected image.

Preferably, the term bodywork element also includes the chassis, floor pan, nose cone, wings, wheels, engine, suspension and any other structural or non-structural portion of the car, to which a visible display could be mounted.

Preferably, the flexible reflective display screen means comprises an electronic reflective display screen means.

Advantageously, the flexible reflective display screen means comprises e-paper.

Preferably, the display screen module is removably held within the shallow recess of the bodywork panel.

Advantageously, the display screen module is held within said shallow recess by a non-permanent adhesive, optionally extending between the second layer of the display screen module and the floor of the shallow recess.

Alternatively, the display screen module may be held within said shallow recess by a non-permanent double-sided adhesive tape, optionally extending between the second layer of the display screen module and the floor of the shallow recess.

In an alternative version of the invention, the display screen module may be fixedly held within the shallow recess.

Preferably, the display screen module has a substantially constant overall thickness.

Preferably, the display screen module is provided with seal means extending along each of its edges between the first layer of optically-clear plastics material and the second layer of protective plastics material, so as to enclose protectively the flexible reflective display screen means on all sides.

Preferably, a circumferential profile of the display screen module conforms substantially to profile of the shallow recess of the bodywork panel.

The display screen module may optionally form an interference fit within the shallow recess.

Preferably, however, a space between respective edges of the display screen module and the shallow recess is filled flush with adjacent bodywork using removable filler material.

Cooperating formations may be provided within the shallow recess and on the edges and/or second layer of the display screen module so as to facilitate location of the display screen module within the shallow recess.

A volume defined between an inner surface of the first layer of optically clear plastics material and an adjacent display surface of the flexible reflective display screen means is preferably filled with an optically clear solid, liquid or gel material.

Preferably, a narrow passage extends through the bodywork panel within the shallow recess, adapted for passage of wiring extending between the display screen module and the control means.

Advantageously, no apertures pass through the bodywork panel within the shallow recess that are larger layer than necessary for passage of wiring.

Preferably, the control means is mounted to the bodywork panel.

Advantageously, the control means is mounted to an internal, in use, face of the bodywork panel, opposite to a face on which the display screen means is visible.

The wiring between the display screen module and the control means may be provided with unpluggable connector means so as to allow replaceable removal of the display screen module from the shallow recess of the bodywork panel.

Preferably, the control means is wirelessly operatively connectable to remote server means, by which image data and/or display instructions for the display screen module may be passed to the control means.

Thus, an operator of the remote server means may transmit instructions and optionally new image data regarding a particular image to the control means, which will in turn control the display screen module to display said image.

Alternatively or additionally, the control means is programmable to change between displayed images at preselected times, without external instructions.

Alternatively or additionally, the control means may be provided with sensor means or linked to sensor means of the vehicle, so as to receive data including vehicle speed and location, and the control means is programmable to change between displayed images in response to said data.

Thus, a particular pre-selected image may be displayed especially when the vehicle is in the pit lane and stopped at the pits, for example.

In some embodiments, the bodywork panel is provided with a plurality of said shallow recesses, each said shallow recess holding a corresponding respective display screen module.

Said display screen modules may then each be operatively connected or connectable to a respective control means.

Alternatively, a single control means may be operatively connected or connectable to each said display screen module.

Preferably, the bodywork element is mountable to a vehicle comprising a racing car.

The bodywork element may be mountable to a Formula car, as defined hereinabove, in which case, the bodywork panel preferably comprises a carbon-fibre composite material.

Alternatively, the bodywork element may be mountable to a GT car, as defined hereinabove, in which case, the bodywork panel may comprise sheet metal and/or plastics material (including a carbon-fibre material).

In embodiments in which an outer surface of the bodywork panel has a visible surface texture, an outer face of the display screen module may be provided with a similar surface texture.

Said surface texture may be embossed on to an outer face of the first layer of optically clear plastics material.

Preferably, a thin clear plastics film having said surface texture embossed into one surface is applied to extend across an outer face of the first layer of optically clear plastics material.

Advantageously, said textured clear plastics film is a flexible vinyl film.

Said textured clear plastics film may be removably applied to the display screen module so as to facilitate repair and refurbishment.

In preferred embodiments of the present invention, the bodywork element comprises a cover sheet of plastics film extending across an outer face of a display screen module and across adjacent portions of the bodywork panel, said adjacent portions being to at least one side of the display screen module.

More preferably, the cover sheet extends across adjacent portions of the bodywork panel, said adjacent portions being to all but one side of the display screen module.

Most preferably, the cover sheet extends across adjacent portions of the bodywork panel to each side of the display screen module.

Preferably, the cover sheet comprises a clear zone aligned with the display screen module and at least one coloured zone extending across a join between the display screen module and the bodywork panel.

Advantageously, said coloured zone is opaquely coloured.

There may be a transitional zone, disposed between the clear zone and the coloured zone of the cover sheet, with an opacity gradient extending across the transitional zone to blend with the coloured zone and the clear zone where they respectively meet.

The cover sheet may further extend across the bodywork panel beyond said adjacent portions thereof.

The cover sheet may expend across a substantial portion or all of the bodywork panel.

The cover sheet may extend across a plurality of display screen modules.

The cover sheet may comprise a flexible sheet of vinyl film.

The cover sheet may be coloured by painting or printing, especially by spray painting or screen printing.

A clear plastics film may be provided extending across substantially a whole of the outer surface of the bodywork element, so as to unify underlying textures and/or to blend in edges of underlying areas of plastics film that cover only a portion of the outer surface of the bodywork element.

Said clear plastics film may comprise a sprayable, peelable vinyl coating.

According to a seventh aspect of the present invention, there is provided a method for producing a bodywork element for a vehicle, adapted for the external display of controllably changeable images, comprising the steps of:

providing a bodywork panel having a shallow recess formed therein;

providing a display screen module comprising flexible reflective display screen means mounted beneath (for example, mounted to) a first layer of optically clear plastics material, optionally between the first layer and a second layer of protective plastics material so as to be visible through said first layer;

fitting the display screen module into the shallow recess, the display screen module being shaped to be received into the shallow recess with its first layer continuing a surface profile of the bodywork panel; and arranging an operative connection between the flexible reflective display screen means of the display screen module and control means therefor, said control means being adapted to control the display screen module to display a selected image.

Preferably the method further includes:

prior to fitting the display screen module into the shallow recess, removeably attaching the first layer of optically clear plastics material to an installation frame;

positioning, using the installation frame, the display screen module within the shallow recess;

fixing the display screen module within the shallow recess; and removing the installation frame from the display screen module.

Advantageously, use of the installation frame increases the speed with which the bodywork panel and corresponding display screen module can be accurately assembled.

Preferably, the installation frame is flexible such that, when the display screen module is removeably attached to the installation frame:

positioning of the display screen module within the shallow recess, using the installation frame, comprises flexing the display screen module and removeably attached installation frame such that the first layer continues the surface profile of the bodywork panel.

Alternatively the installation frame may be pre-formed into a shape that conforms to a profile of the first layer, for example a profile of the perimeter of the first layer.

Optionally the method further includes, prior to positioning the display screen module within the shallow recess, applying an adhesive material to one or both of the display screen module and the shallow recess;

wherein fixing the display screen module within the shallow recess includes curing the adhesive.

Optionally the adhesive is a UV curable adhesive, and fixing the display screen module within the shallow recess includes applying UV radiation to the adhesive.

Optionally the installation frame includes one or more UV radiation sources, and applying UV radiation to the adhesive includes operating the one or more UV radiation sources.

Optionally the first layer is moulded so as to continue the surface profile of the bodywork panel, for example by vacuum forming.

Optionally, the control means is mounted or mountable to the bodywork panel.

Alternatively the display screen module comprises the control means, wherein the control means are mounted to the flexible reflective display screen means.

Optionally the shallow recess comprises a further recess configured to receive the control means.

Advantageously, the control means is adapted to receive image data and instructions from remote server means, optionally by radio.

Preferably, the method comprises the preliminary step of forming the display screen module by mounting said first layer and said second layer to opposite faces of the flexible reflective display screen means and providing seal means extending along each edge of the display screen module between said first and second layers, so as to enclose the flexible reflective display screen means to all sides.

The method preferably comprises the step of filling any volume extending between an inner surface of the first layer and an adjacent display surface of the flexible reflective display screen means with an optically-clear solid, liquid or gel material.

In embodiments in which an outer surface of the bodywork panel has a visible surface texture, the method may comprise providing an outer face of the display screen module with a similar surface texture, optionally by providing a thin clear plastics film having said surface texture embossed into one surface and applying it to extend across an outer face of the first layer of optically clear plastics material The method may comprise the step of providing a cover sheet of plastics film and applying it to extend across an outer face of a display screen module and across adjacent portions of the bodywork panel, said adjacent portions being to at least one side of the display screen module.

The method may comprise providing said cover sheet with a clear zone and at least one coloured zone, and applying the cover sheet with the clear zone aligned with the display screen module and the or each coloured zone extending across a join between the display screen module and the bodywork panel.

Preferably, said bodywork element comprises a bodywork element as described in the fifth aspect above.

Also provided is an installation frame, or jig, for installing a display screen module in a shallow recess on a vehicle, wherein:

the installation frame is configured to lie substantially flush against at least a perimeter of an outer surface of a display screen module when brought into contact with the outer surface of the display screen module (e.g., the installation frame has a shape conforming to a profile of at least a perimeter of a display screen module);

the installation frame has outside dimensions greater than corresponding outside dimensions of the display screen module such that the installation frame extends beyond the edges of the display screen module when brought into contact with the display screen module; and the installation frame comprises removable attachment means, wherein the removable attachment means are configured to allow the installation frame to be removeably attached to the outer surface of the display screen module;

Preferably the installation frame comprises a cutout, the cutout having inside dimensions less than corresponding outside dimensions of the display module.

Optionally the installation frame comprises one or more UV radiation sources, for example one or more UV LEDs.

Optionally the removable attachment means is transparent to UV radiation, and optionally comprises a double sided adhesive tape.

Optionally the installation frame comprises a plastics material, and is moulded to the required shape.

According to an eighth aspect of the present invention, there is provided a method for arranging display of advertising images on a vehicle, comprising the steps of:

providing a vehicle and at least one bodywork element for said vehicle, wherein the at least one bodywork element comprises a bodywork element as described in the first aspect above;

mounting said at least one bodywork element to the vehicle;

providing at least one set of instructions for generation of an advertising image on a display screen module of said at least one bodywork element;

storing said set of instructions on control means of the bodywork element or on remote server means remotely operatively connectable to said control means;

arranging agreed conditions under which a particular said advertising image is to be displayed; and under said agreed conditions causing the control means to pass a particular set of instructions to the display screen module such that it displays the particular said advertising image to be viewed externally to the vehicle.

The agreed conditions may comprise specified periods of time, e.g. during a race.

The agreed conditions may comprise specific vehicle locations, specified vehicle speed ranges, including being stationary, or the like.

Embodiments of the present invention will now be described more particularly and by way of example, in which.

Figure 1:
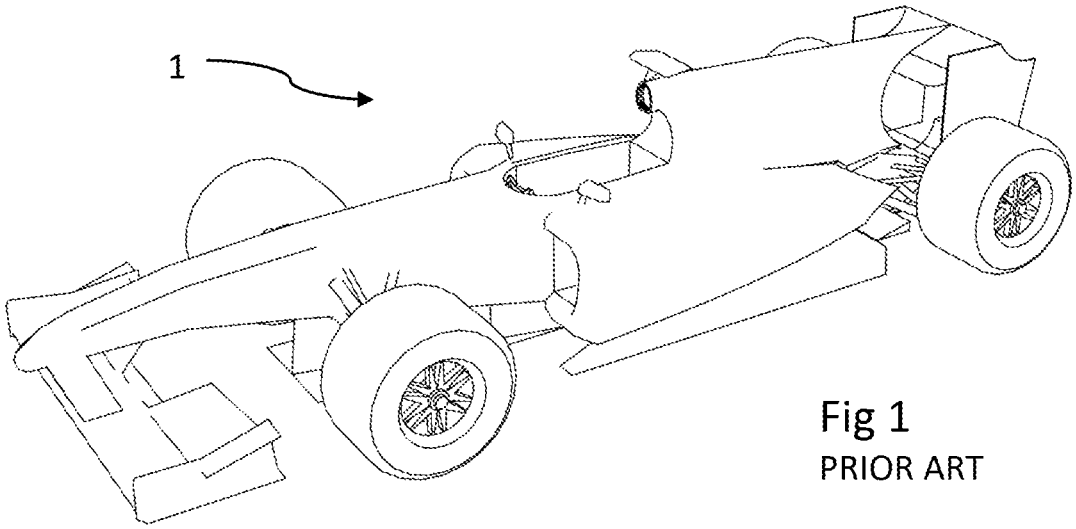
Fig 1 PRIOR ART
FIG. 1 is a perspective view of a motor racing car of typical "Formula car" construction.
Figure 2:
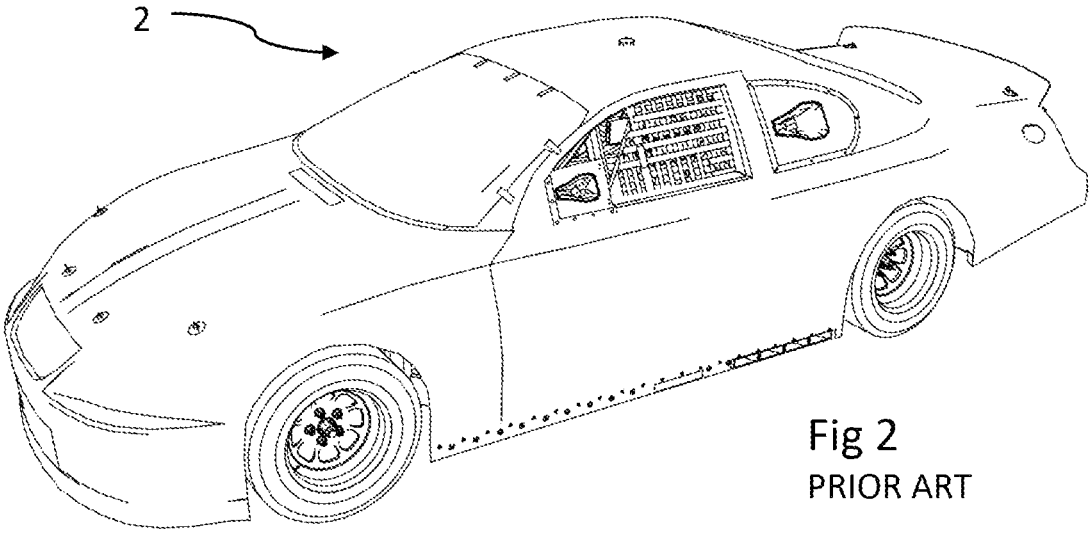
Fig 2 PRIOR ART
FIG. 2 is a perspective view of a motor racing car of typical "GT car" construction.

Referring now to the Figures and to FIGS. 1 and 2 in particular, FIG. 1 shows a typical Formula Car form of motor racing car 1, here a Formula 1 car. As can be seen, this has a body shell shaped mainly in the interests of high-speed aerodynamics, with pronounced curvature, both convex and concave. The bodywork still needs to be used as the substrate for multiple logos, brand names and other insignia for long-term sponsors and shorter-term advertisers, as well as team and driver branding.

FIG. 2 shows a typical GT car 2. While such motor racing cars are limited to being based on conventional road-going motor cars, the bodywork still tends to be curved for aerodynamic effect, and is used as the substrate for logos, branding and the like for teams, sponsors, advertisers and drivers.

While the embodiments below are discussed primarily in relation to body panels for cars such as Formula 1 and GT cars, it will be appreciated that the present invention may be equally applied to other racing vehicles, for example power boats, off-road vehicles, etc.

Figure 3:
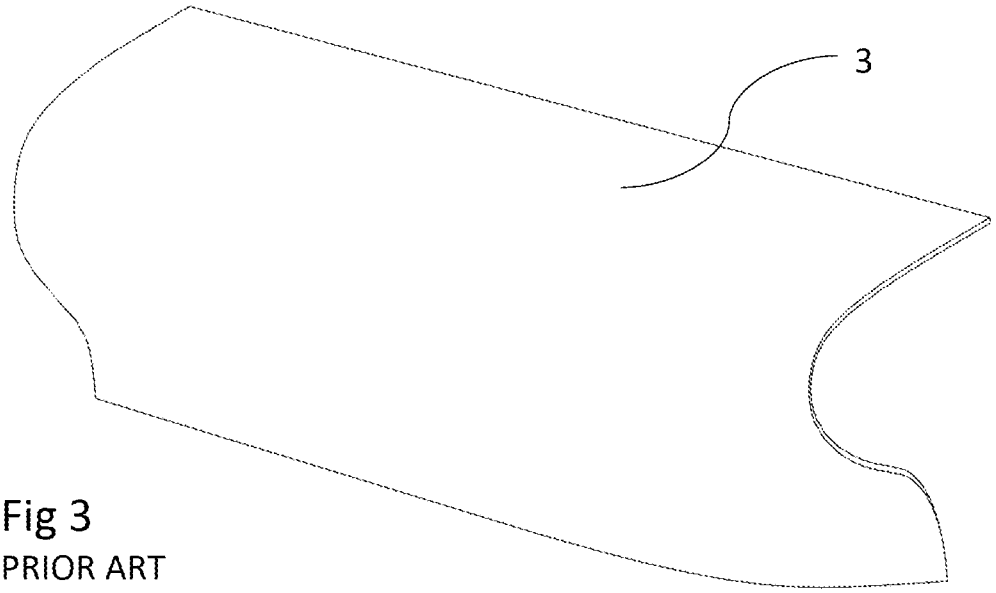
Fig 3 PRIOR ART
FIG. 3 is a perspective view of a sidepod bodywork panel from the racing car of FIG. 1.

FIG. 3 shows a typical bodywork panel 3 from a Formula 1 racing car 1. These panels are generally bolted to a monocoque chassis, and are routinely removeable, for example to replace damaged panels, to access interior workings of the car, or (between races) to be replaced with panels with improved aerodynamic profiles.

Figure 4:
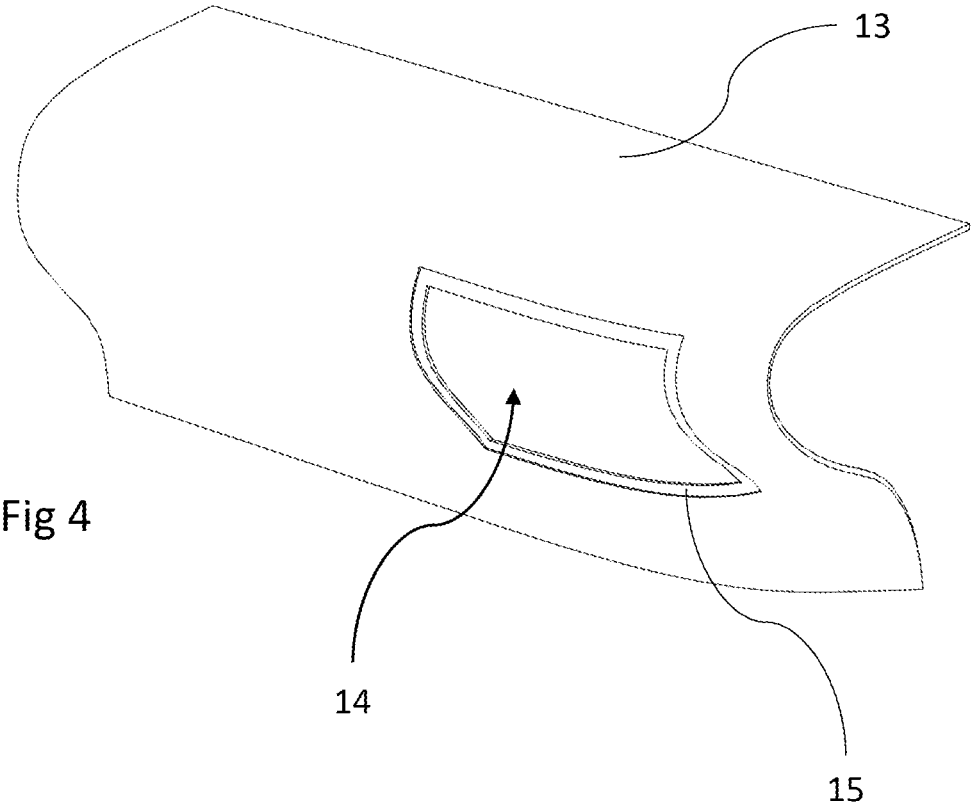
FIG. 4 is a perspective view of a sidepod bodywork panel for the racing car of FIG. 1, embodying the present invention.

In the present invention, as shown in FIG. 4, the bodywork panel 3 is replaced by a modified bodywork panel 13, in which an aperture 14, here generally rectangular, has been formed. It is generally easier with bodywork panels 13 of Formula cars 1 to create such apertures 14 as the panels 13 are produced, due to the materials of construction (see FIG. 5 below). For GT cars 2, which typically have metal bodywork panels, it may be easier to cut a suitably-shaped aperture 14 into a pre-formed bodywork panel 3. In either case, it is preferable to have a shallow rebate 15 created, extending around a circumference of the aperture 14, facing an exterior of the bodywork panel 3, 13.

Figure 5:
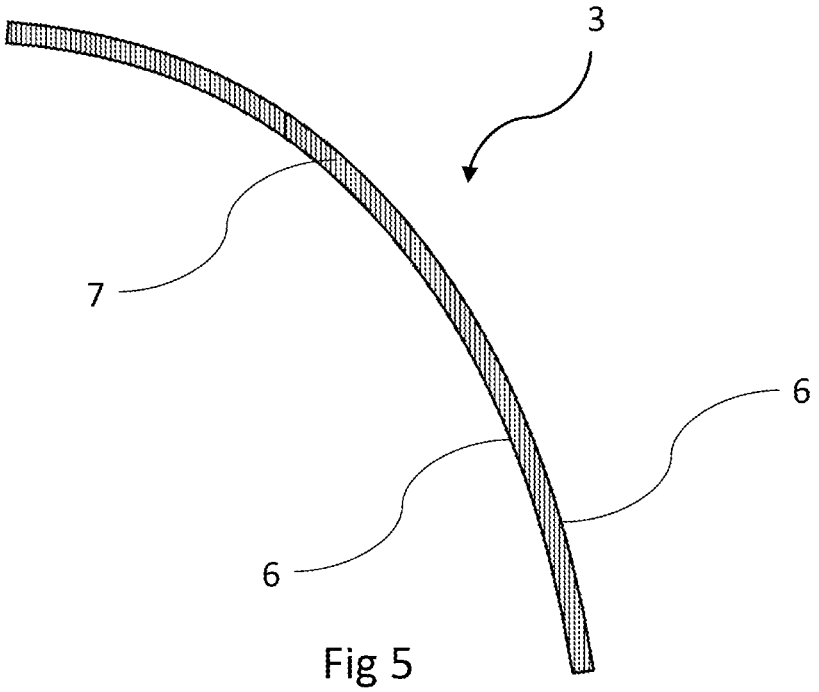
Fig 5 PRIOR ART
FIG. 5 is a scrap cross-section of the bodywork panel of FIG. 3, showing its internal structure.

FIG. 5 shows the typical structure of a bodywork panel 3 of a Formula car 1. Since total car weight is critical, these are usually constructed for minimum weight with just sufficient strength and stiffness. Two plies 6 of carbon fibre composite material, each typically 0.5 mm thick, sandwich a core 7 of Nomex paper honeycomb approximately 5 mm thick (Nomex is a registered trade mark of Du Pont). Each bodywork panel 3 is moulded to exactly the required profile before the carbon fibre composite plies 6 are curved. While such bodywork panels 3 are thicker than a conventional metal panel, they are stronger and stiffer for a given weight.

Figure 6:
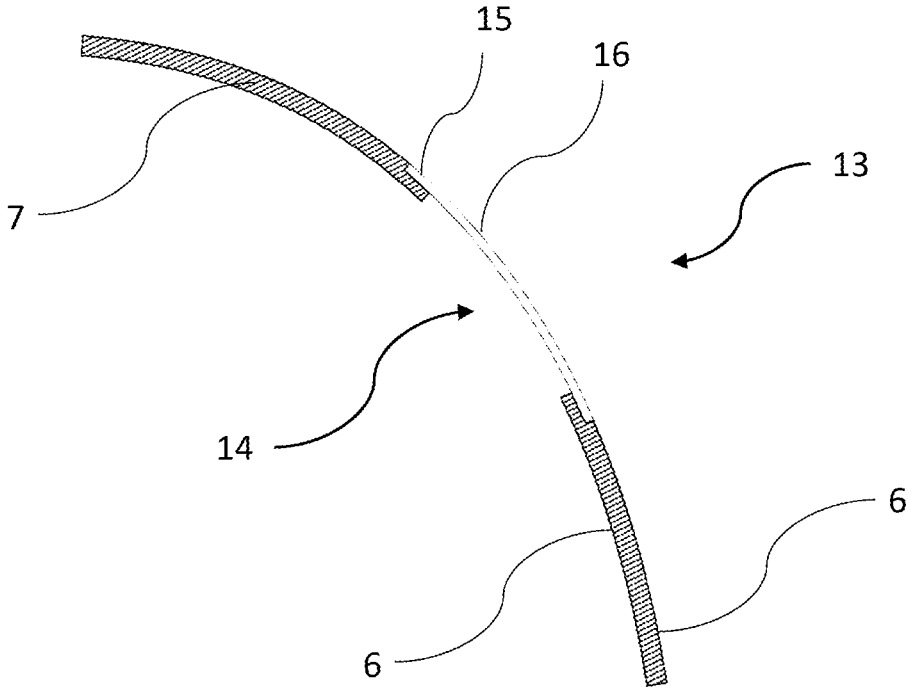
FIG. 6 is a scrap cross-section of the bodywork panel embodying the present invention of FIG. 4, taken across the aperture formed therein.

FIG. 6 shows in cross-section a bodywork panel 13 with an aperture 14 as in FIG. 4. As a first step towards installing a display screen, an optically clear plastics panel 16 has been moulded (for example from poly (methyl methacrylate)), to fit across the aperture 14, with an outer margin of the optically clear panel 16 supported by the rebate 15 formed around the circumference of the aperture 14. An external profile of the optically clear panel 16 is shaped to continue an external profile of the bodywork panel 13, so that the aerodynamic performance of the bodywork panel 13 is unaffected. Any peripheral gaps between an outer circumference of the optically clear panel 16 and the bodywork panel 13 are filled and blended with conventional body filler materials to eliminate as far as possible any discontinuities in an exterior surface of the background panel 13. In this embodiment of the present invention, the optically clear panel 16 is fixed to the rebate 15 with a suitable conventional adhesive.

When the bodywork panel 13 is subsequently painted in the team or sponsor colours, the paint finish can be extended over the join between the bodywork panel 13 itself and the optically clear panel 16 and feathered inwardly over a marginal region of the optically clear panel 16. This is partly to conceal the joint between the bodywork panel 13 and the optically clear panel 16, both visually and on a microscopic physical scale to maintain aerodynamics smoothness (a further benefit is described below).

Figure 7:
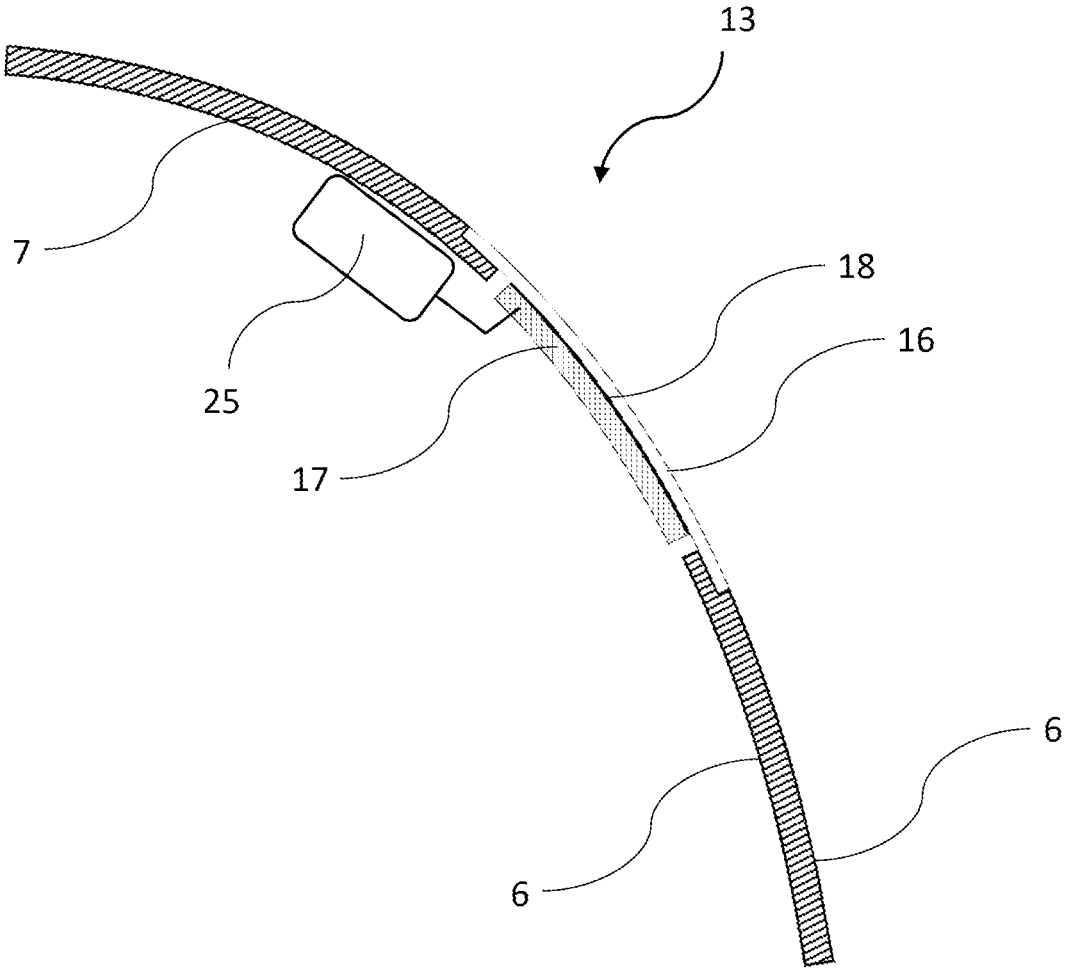
FIG. 7 is a scrap cross-section of the bodywork panel embodying the present invention of FIG. 4, with a display screen fitted according to a first aspect of the present invention.

FIG. 7 shows a scrap-cross section of a bodywork panel 13 with a display screen fitted according to a first aspect of the present invention. Here, a flexible display screen 17, ideally a reflective electronic display such as that conventionally known as "e-paper", is mounted to an interior surface of the optically clear panel 16, by means of a layer of optically clear adhesive 18. It is important that the optically-clear adhesive 18 completely fills any voidage between contacting faces of the flexible display screen 17 and the optically clear panel 16, to make images displayed on the flexible display screen 17 as clearly visible as possible from outside the bodywork panel 13.

Such e-paper flexible display screens 17 can nowadays be made to display colours, as well as the original black and white displays to simulate ink on paper. When images are displayed on the flexible display screen 17 (see below), a background to the images can be made substantially the same colour as the paint finish of the bodywork panel 13, and in combination with the feathered edge to the paint finish around the margin of the optically clear panel 16 (described above), this should make the optically clear panel 16 visually blend seamlessly into the bodywork panel 13, making it appear as if the displayed images were displayed on the surface of the bodywork panel 13.

An alternative approach is for the paint finish to be extended over the join between the bodywork panel 13 and the optically clear panel 16, but for a shape of the inner edge of the paint finish not to correspond to a shape of the outer edge of the optically clear panel 16 or to a shape of an outer edge of the display screen 17 beneath the optically clear panel 16. (Typically, the aperture 14, the optically clear panel 16 and the display screen 17 would all be generally rectangular). Thus, the join is camouflaged and the shapes of the optically clear panel 16 and display screen 17 are obscured.

This allows the creation of an illusion of a standalone painted graphic on a background having a colour contrasting with a remainder of the bodywork. (For example, in the 2018 version of the traditionally all-over red Ferrari livery, there is a trapezoidal or "keystone" shaped white area on the nose that acts as a contrasting background for the car number.) A similar shape for an inner margin of the paint finish of a bodywork panel of the present invention would create a "frame", concealing the rectangular shape of the optically clear panel and the display screen, distracting the viewer's eye from their true shape, and allowing the display of images on a contrasting background of specified shape or on a background of the same colour blending into the overall bodywork paint finish.

The images displayed on the flexible display screen 17 are controlled via a display controller 25, here shown schematically, which is linked by radio to a remote server, located adjacent the racing track, for example in the "pits". This allows transmission of instructions, via the display controller 25, to change the images shown on the flexible display screen 17 as desired.

Figure 8:
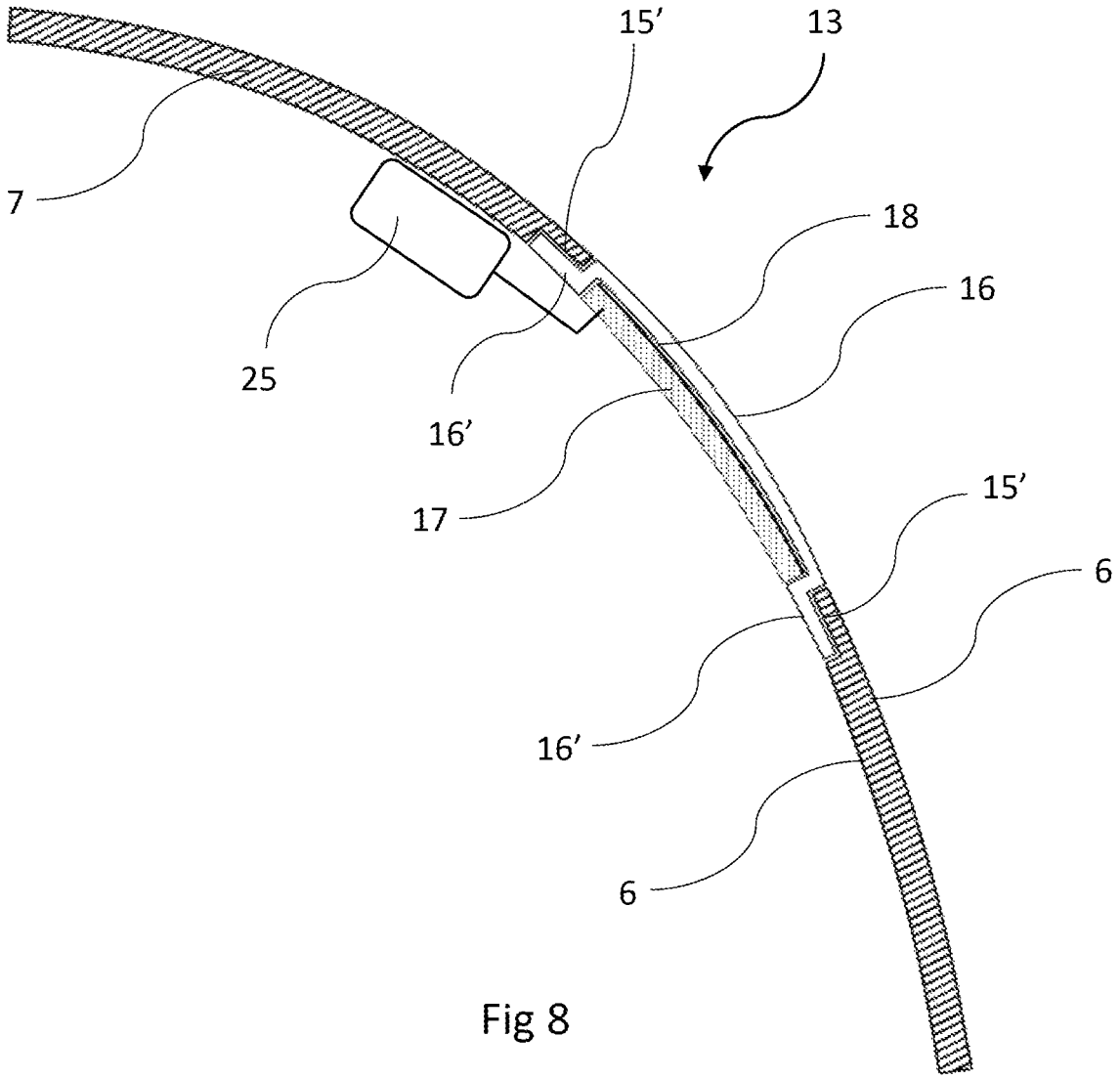
FIG. 8 is a scrap cross-section of the bodywork panel embodying the present invention of FIG. 4, with a display screen fitted according to a second aspect of the present invention.

FIG. 8 shows a bodywork panel 13 with a display screen fitted according to a second aspect of the present invention. A flexible display screen 17 of e-paper, substantially identical to that shown in FIG. 7, is mounted to an interior surface of the optically clear panel 16 by a layer of optically clear adhesive 17, again as described above for FIG. 7. In this case, the optically clear panel 16 is fixed to the rebate 15 around the aperture 14 in the bodywork panel 13 by means of screw or bolt fittings 19. These could be used in addition to the adhesive used in the arrangement of FIG. 7, but in this case, they allow the optically clear panel 16 and attached flexible display screen 17 to be unfastened, removed and replaced as a unit, for example if the optically clear panel 16 has itself been damaged (e.g. by debris flung up from the track or by collision) or if the flexible display screen 17 has become defective and needs repair or replacement.

This arrangement, like that shown in FIG. 7, has a display controller 25 operatively linked to the flexible display screen 17 and to a remote server, so that the images on the flexible display screen 17 can be controlled as desired.

Figure 9:
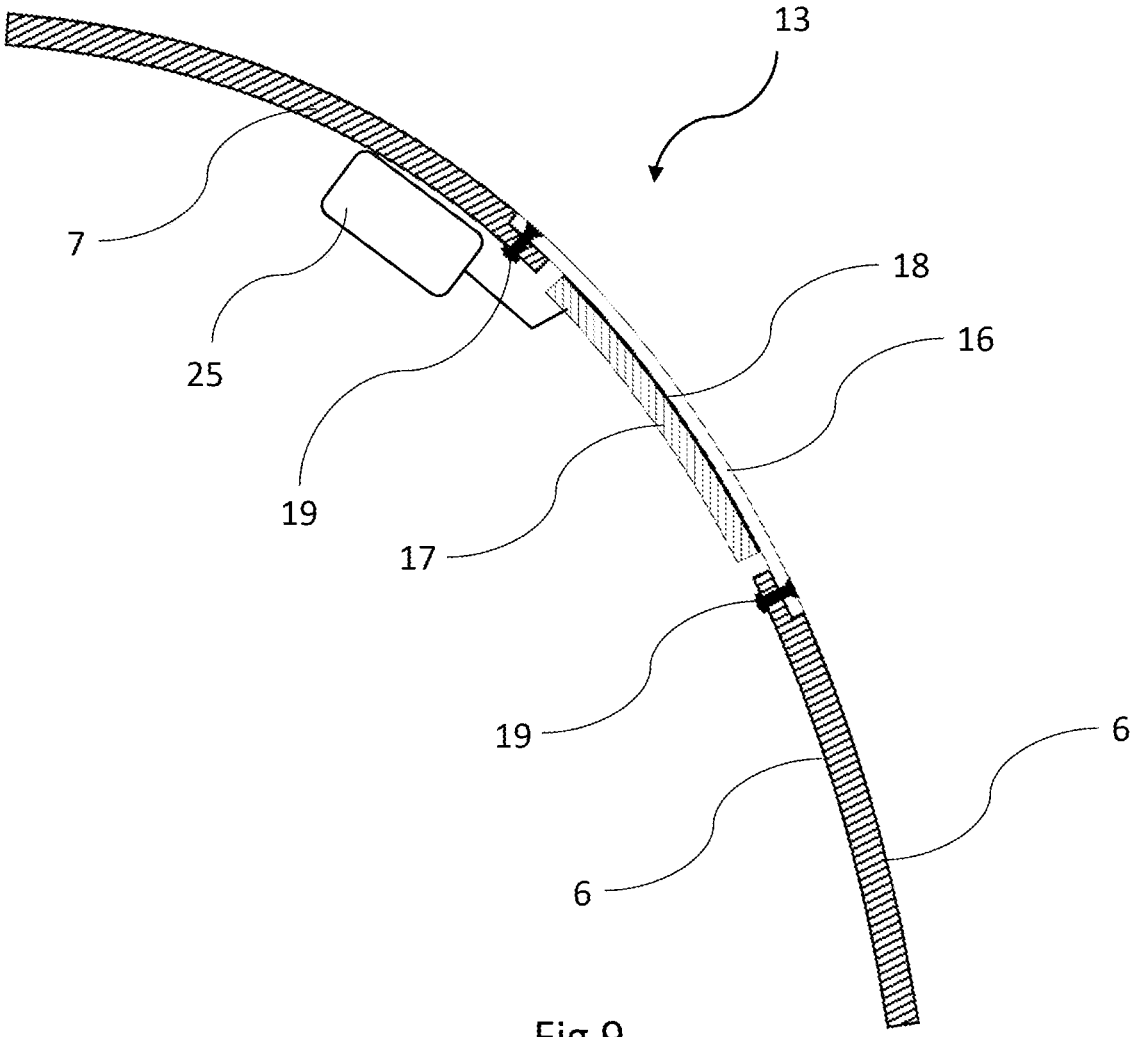
FIG. 9 is a scrap cross-section of the bodywork panel embodying the present invention of FIG. 4, with a display screen fitted according to a third aspect of the present invention.
Figure 10:
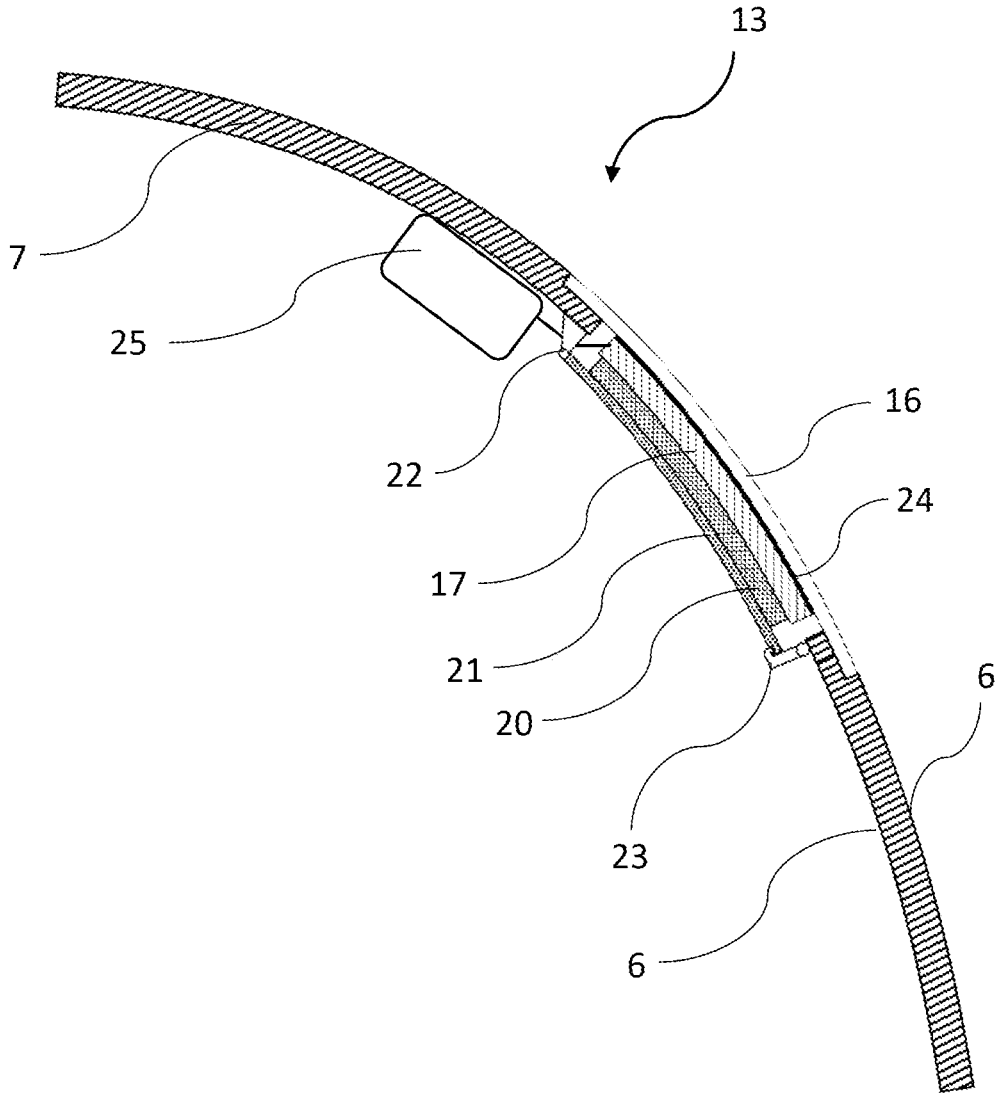
FIG. 10 is a scrap cross section of the bodywork panel of FIG. 4, with a display screen fitted according to a fourth embodiment of the present invention.

FIG. 9 shows the bodywork panel 13 with a display screen fitted according to a third aspect of the present invention.

The flexible display screen 17 of e-paper is substantially the same as in FIGS. 7 and 8, and the optically clear panel 16 is glued to the rebate 15 as shown in FIGS. 6 and 7. In this case, however, the flexible display screen 17 is held against the interior surface of the optically clear panel 16 by a substantially co-extensive resiliently compressible foam pad 20, which itself is held in place by a retaining panel 21. The retaining panel 21 is mounted to an interior face of the bodywork panel 13 by a hinge mounting 22 located to a first side of the aperture 14, and a detent clip mounting 23 located adjacent a second side of the aperture 14 remote from the first. When the retaining panel 21 is clipped in place by the detent clip mounting 23, the foam pad 20 is compressed between the retaining panel 21 and the flexible display screen 17, holding the latter securely in place. In place of the optically clear adhesive 18 used as shown in FIGS. 7 and 8, an optically clear grease 24 is here used to fill any voidage between the respective contact faces of the flexible display screen 17 and the optically clear panel 16, maximising the visibility of images shown on the flexible display screen 17. An alternative to the grease 24 would be to use a pad of optically clear gel (not illustrated). As described for the other arrangements shown, the flexible display screen 17 is controlled via the display controller 25 from a remote server.

In this arrangement, the flexible display screen 17 can readily be removed from the particular bodywork panel 13, either to be replaced if it has become defective or needs to be upgraded, or to allow it to be transferred to a different bodywork panel 13, perhaps having different aerodynamic curvature.

Multiple display screens 17 can be fitted into the same bodywork panel 13, and/or multiple bodywork panels 13 of the car 1 can be fitted with a display screen 17. While each such display screen 17 may be connected to its own individual display controller 25, it would also be possible to have a single display controller 25 controlling multiple display screens 17. The exact balance probably depends on the weight of the display controllers 17 and the weight and complexity of the wiring loom needed if multiple display screens 17 were operatively connected to a small number of display controllers 25.

In a simpler embodiment of the invention (not illustrated), the display controller 25 would not be connected to a remote server, but instead would be set up before a race, preprogrammed with a sequence of images to be shown for specified periods of time. This would not be as responsive as the main embodiments, above, with control in real time from a remote server. However, in less "high-tech" venues than the typical Grand Prix race track, this simpler version of the system might be more practicable.

Figure 16:
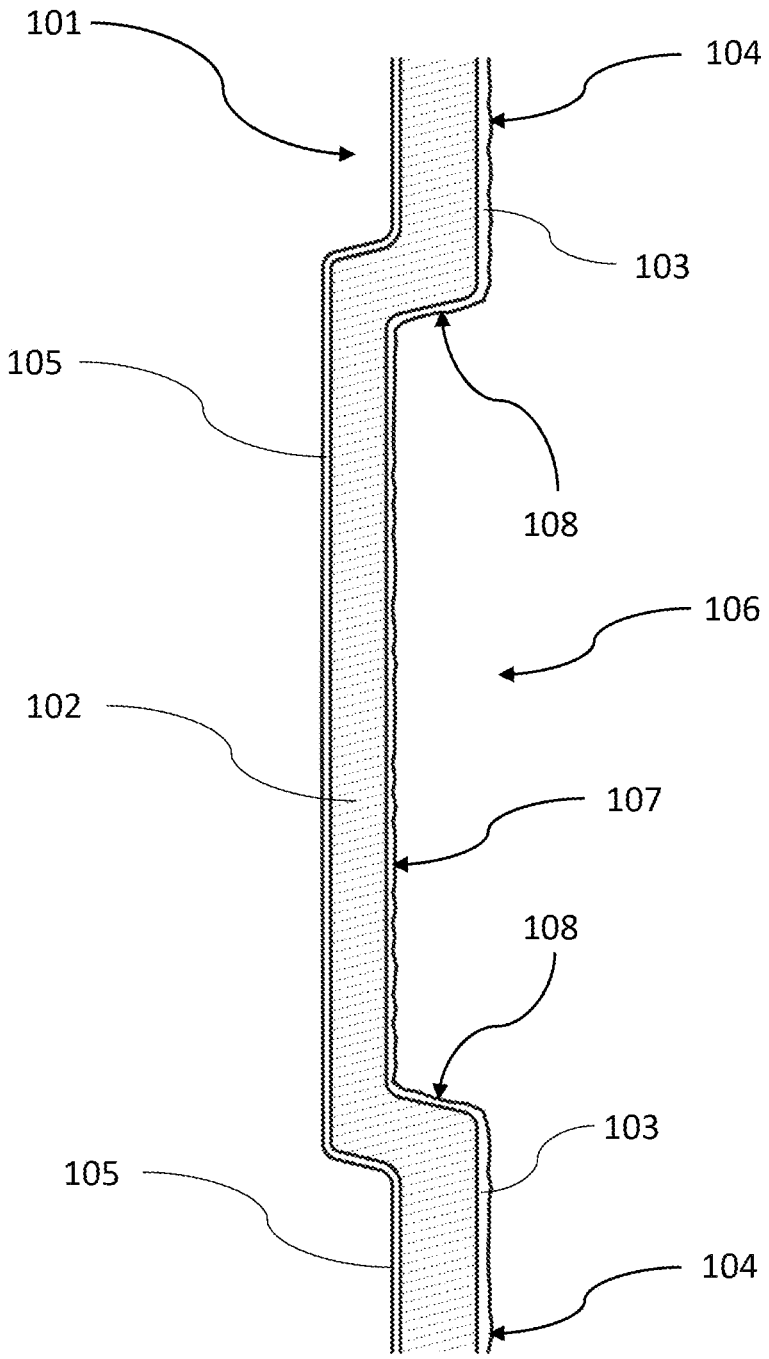
FIG. 16 is a cross-section of a bodywork panel of the present invention.

Referring now to FIG. 16, a first body panel 101 for a racing car is shown in cross section. As normal, the bodywork panel 101 is made up of a core 102 of honeycomb structure Nomex® or equivalent high-performance polymer, typically about 5 mm thick, sandwiched between a first layer 103 of carbon fibre composite material, which forms an outer surface 104 of the body panel 101 in use, and a second layer 105 of carbon-fibre composite material, which forms an inner surface of the bodywork panel 101. Both carbon fibre composite layers 3,5 are about 0.5 mm thick.

The bodywork panel 101 shown has been moulded specially for use in the present invention. A shallow, broad recess 106 is formed, indented into the outer surface 104 of the panel 101 and protruding to the inside of the bodywork panel 101. The recess 106 has a floor 107 matching the curvature of the panel 101 (here, both are shown substantially flat, for simplicity), and walls 108 that extend nearly perpendicular to the floor 107 and to adjacent portions of the panel 101 (although the practicalities of moulding will mean that there will almost inevitably be a slight slope to the walls 108, as shown). It is worth noting that the slightly irregular profile shown for the outer surface 104 of the first carbon-fibre layer 103 of the panel 101 is actually present and visible in practice.

Figure 17:
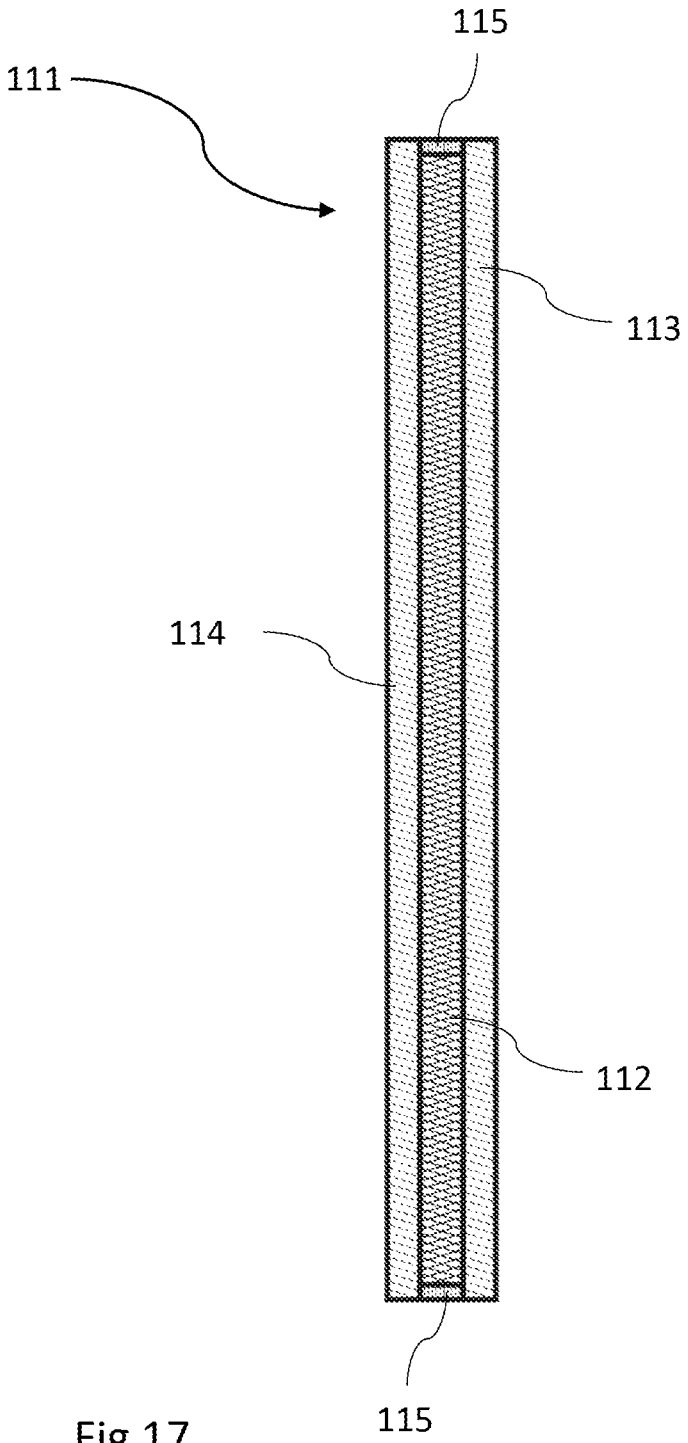
FIG. 17 is a cross-section of a display screen module of the present invention.

FIG. 17 shows in cross section a display screen module 111 for fitting to the bodywork panel 101 of FIG. 16. The display screen module 111 comprises a flexible display screen 112, ideally a reflective electronic display such as that conventionally known as "e-paper", sandwiched between a first, front layer 113 of optically-clear plastics material, through which images produced on the display screen 112 can be seen, and a second, back, layer 114 of protective plastics material. Ideally, an optically-clear adhesive (for example a UV-curable adhesive) is used to secure the flexible display screen 112 to the first, frontal layer 113, fully filling any space left between them to ensure optimum visibility of the flexible display screen 112 through the first, frontal layer 113. Both front and back layers 113, 114 can conveniently be made from polycarbonate, which can be made is sufficiently optically clear for the first layer 113, and is sufficiently strong and impact-resistant to also be used as the protective back layer 114 (although optical clarity would not be important here). A seal or sealant 115 extends around each edge of the display screen module 111, filling the gap between the layers 113, 114 so as to protect the flexible display screen 112 to all sides.

The display screen module 111 shown is substantially flat, to match the profile of the particular bodywork panel 101 shown, adjacent the recess 106 and the profile of the floor 107 of the recess 106. However, in other embodiments where the panel 101 is curved, the display screen module 111 can be made similarly curved. Alternatively, the display screen module 111 may be flexed into place, and held in place with adhesive. The front and back layers 113, 114 can easily be moulded to a desired curve, and a major advantage of e-paper and the like for the flexible display screen 112 is that it will readily adopt the curve of the layers 113, 114 enclosing it, without degradation in performance.

FIG. 18 shows, again in cross-section, the bodywork panel 101 of FIG. 16 fitted with the display screen module 111 of FIG. 17, to form a first bodywork element 121 embodying the present invention. The display screen module 111 fits into and fills the recess 116. It is here held in place by a layer of non-permanent adhesive 122 extending between the floor 107 of the recess 106 and the second, back layer 114 of the module 111 (a non-permanent double-sided adhesive tape could also be used) Any gap between the walls 108 of the recess 106 and the edges of the module 111 is filled with a suitable removable filler material 123.

As noted above, the outer surface 104 of the first carbon fibre layer 103 of the bodywork panel 101 has a visible texture. The outer layer 113 of the display screen module 111 will be noticeably smoother, and so a piece of clear textured film 124 is laid across the whole outer layer 113, so that it blends in with the surrounding bodywork panel 101. (More details of this clear textured film are provided below).

In order to blend the display screen module 111 into the bodywork panel 101 further, an outer vinyl sheet 125 is applied to extend across both. When the only concern is the profile of the bodywork panel 121 as a whole, this outer vinyl sheet 125 may be clear, and could extend all the way to a margin of the bodywork panel 101. When it is desired to cover up the joints between components, including the filler 123, pigmented/painted/printed vinyl sheets may be used, which can be extended across the whole bodywork panel 101, across a part of the bodywork panel 101, or just locally around the display panel module 111 and the recess 106. These various approaches will also be shown below.

Figure 19:
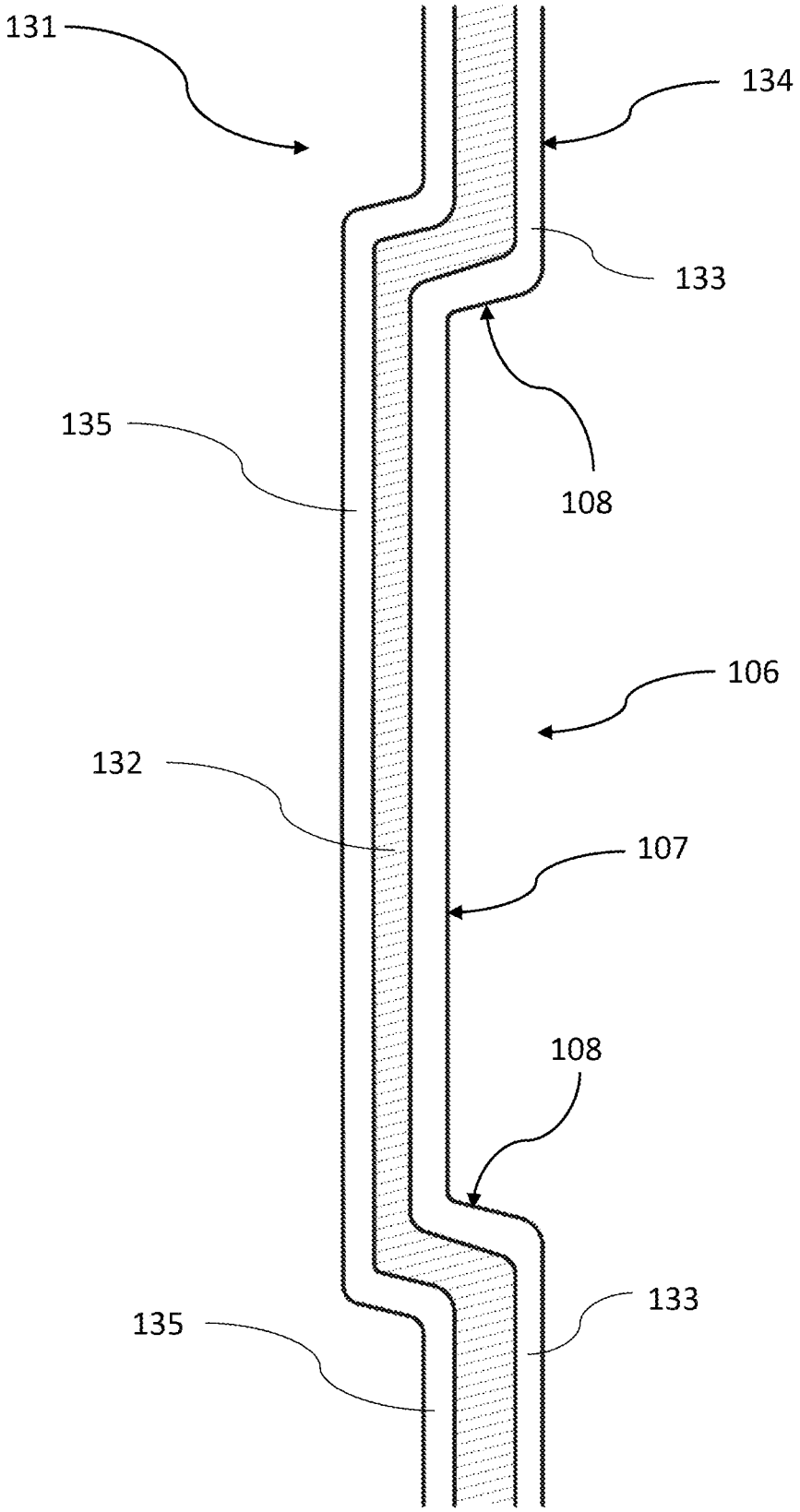
FIG. 19 is a cross-section of a bodywork panel of the present invention.
Figure 20:
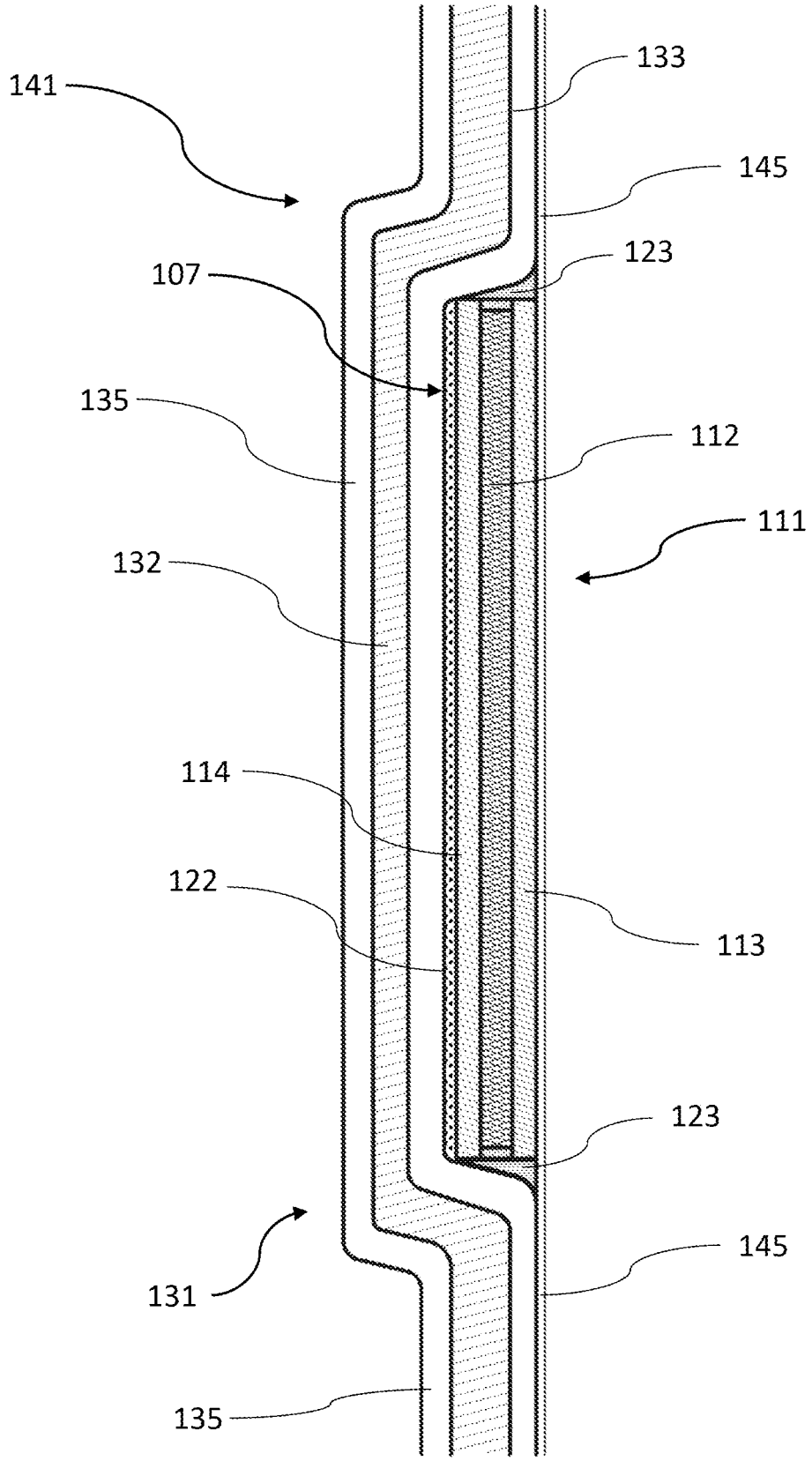
FIG. 20 is a cross-section of a bodywork element embodying the present invention with the display screen module of FIG. 17 mounted to the bodywork panel of FIG. 19.

FIGS. 19 and 20 show a simpler embodiment of the present invention. A second bodywork panel 131 is intended for use on a part of the racing car requiring greater strength than for the first bodywork panel 101 of FIG. 16, such as the chassis and wings. The core 132 is relatively thinner, while the carbon fibre composite first layer 133 and second layer 135 are relatively thicker than for the first bodywork panel 101. This extra thickness of carbon fibre means that an outer surface 134 of the second bodywork panel 131 is now relatively smooth, and the texture shown in FIG. 16 is not present.

The second bodywork panel 131, like the first 101, has a broad, shallow recess 106 moulded into it, with a floor 107 generally following the profile of the bodywork panel 131 adjacent to the recess 106, and walls 108 extending nearly perpendicular to the floor 107.

In FIG. 20, again in cross-section, the bodywork panel 131 of FIG. 19 is fitted with the display screen module 111 of FIG. 17, to form a second bodywork element 141 embodying the present invention. The structure is substantially the same as for the first bodywork element 121 in FIG. 18, except that no textured film 124 is present, since the second bodywork panel 131 itself does not show significant texturing. The outer vinyl sheet 145 is still present, either (as shown) clear to blend in the surface profile of the bodywork element 141, or pigmented/painted/printed to help visual blending.

Figure 21:
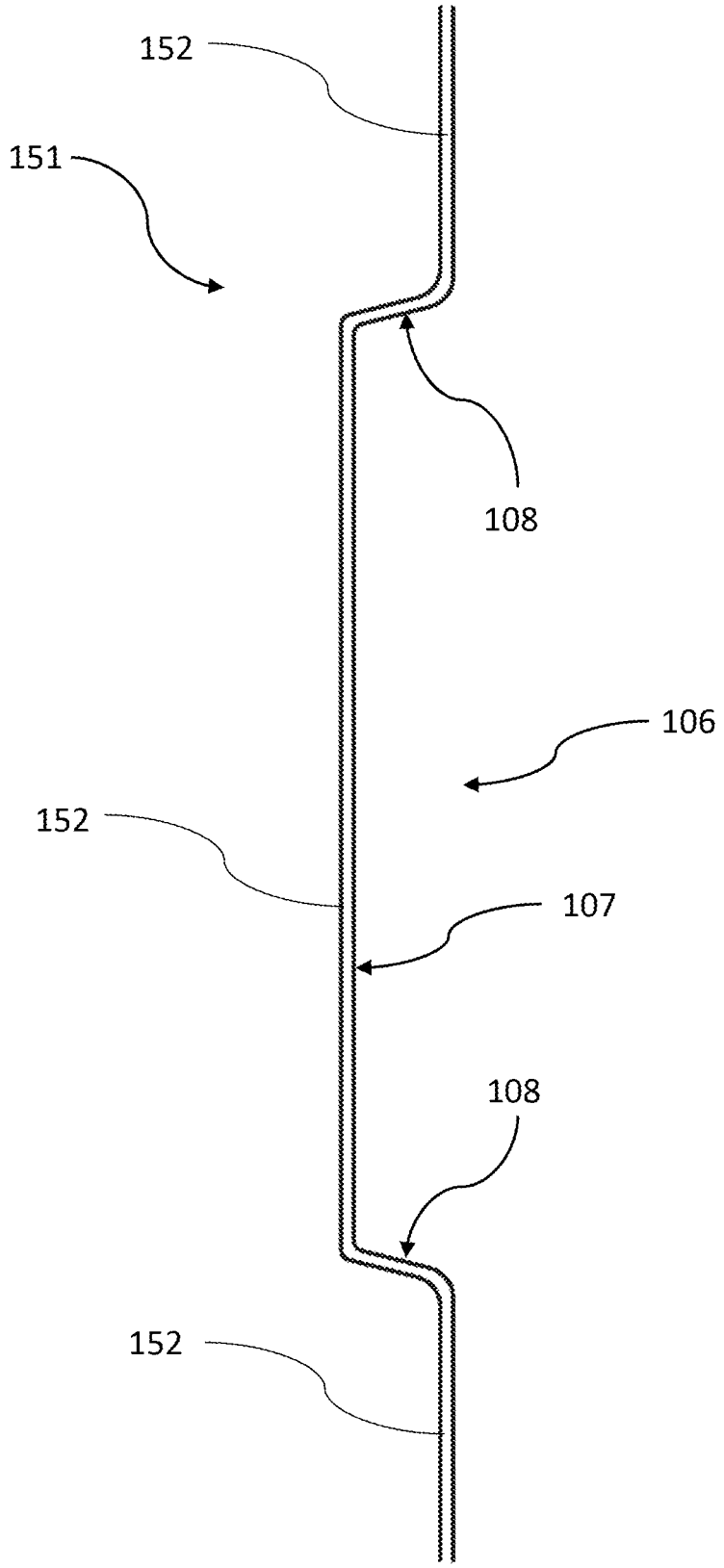
FIG. 21 is a cross-section of a bodywork panel of the present invention.
Figure 22:
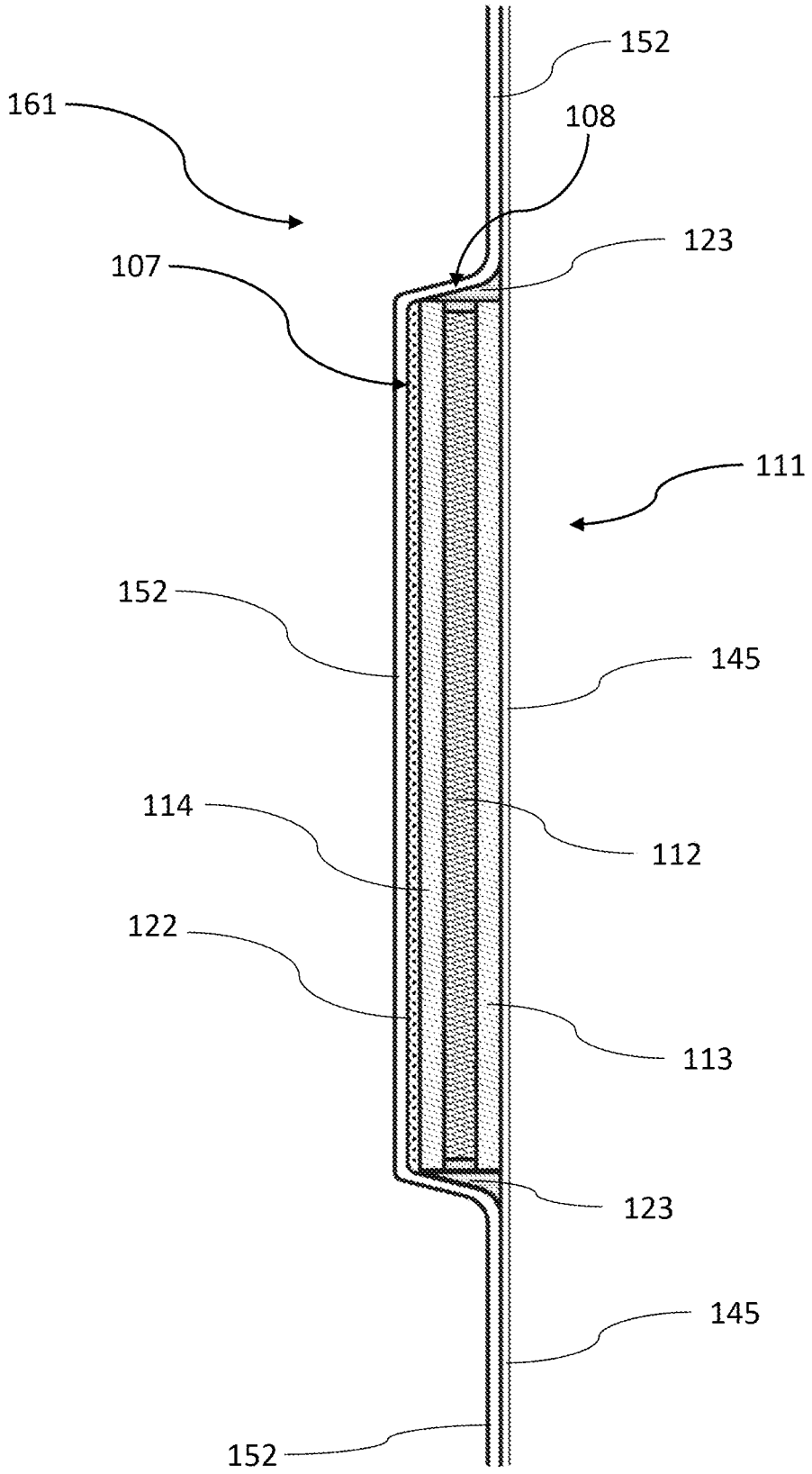
FIG. 22 is a cross-section of a bodywork element embodying the present application, with the display screen module of FIG. 17 mounted to the bodywork panel of FIG. 21.

FIGS. 21 and 22 show how the present invention can be applied to a GT car. A third bodywork panel 151 is formed from conventional steel or aluminium alloy sheet 152, using conventional metal-forming techniques. (NB: occasionally, Formula cars can have panels comprising just a single layer of carbon fibre composite, which will have the same appearance as shown here for metal panels. As for the first 101 and second 131 bodywork panels, the third bodywork panel 151 also has a broad, shallow recess 106 moulded to it, with a floor 107 generally following the adjacent profile of the bodywork panel 151, and walls 108 of the recess 106 extending nearly perpendicular to the floor 107.

In FIG. 22, the third bodywork panel 151 of FIG. 21 is fitted with the display screen module 111 of FIG. 17, forming a third bodywork element 161 embodying the present invention. The structure is substantially the same as for the second bodywork element in FIG. 20, since the metal sheet 152 has no texturing issues, and so no textured film 124 is needed to blend in the display screen module 111. The outer vinyl sheet 145 is again present, to help to blend in the surface profile around the display screen module 111 and/or help conceal the edges of the display screen module 111 visually.

Figure 23:
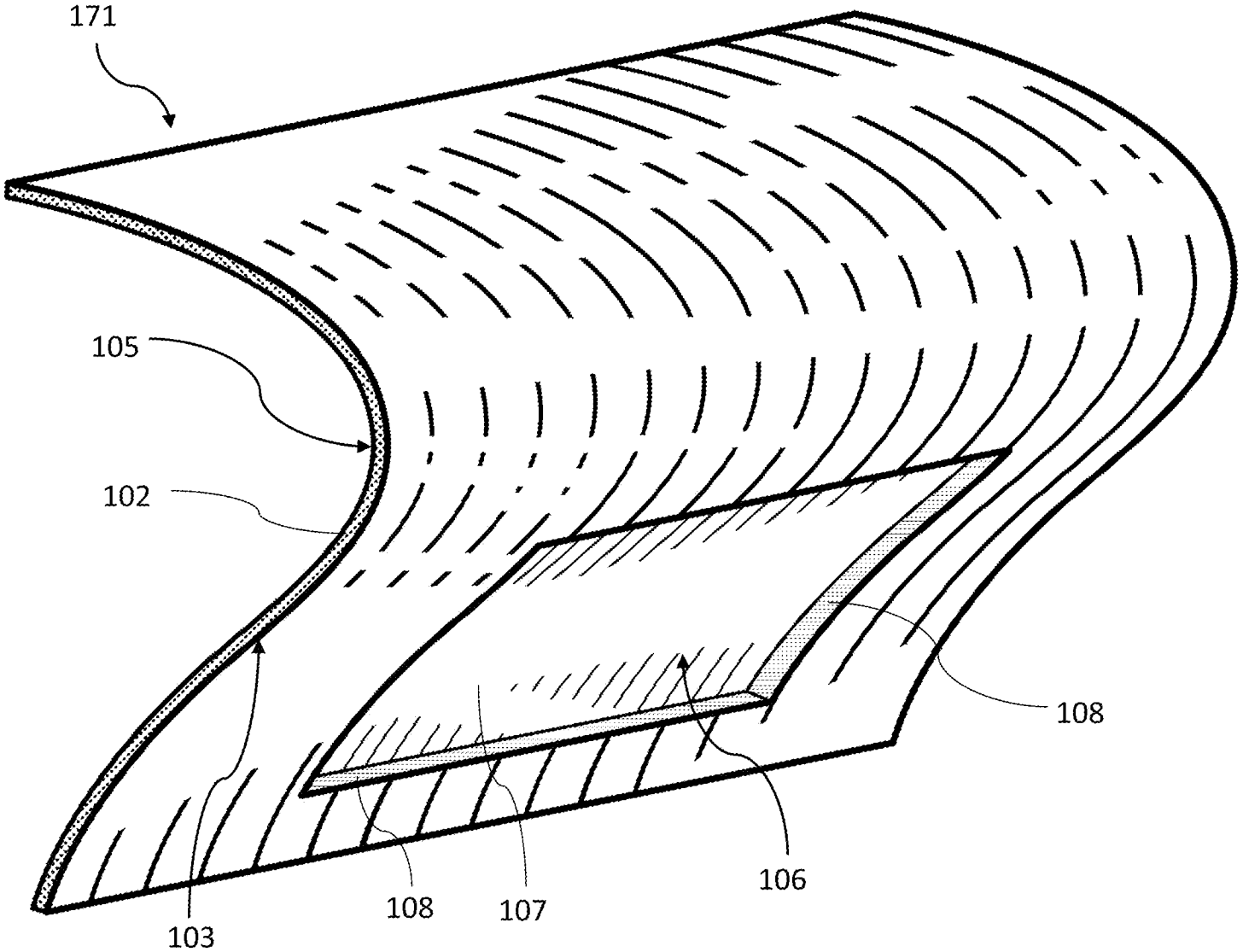
FIG. 23 is a perspective view of a bodywork element embodying the present invention.

In FIG. 23, a fourth bodywork panel 171 is shown, to illustrate the invention implemented on a curved area of bodywork. The bodywork panel 171 is again made from a Nomex® core 102, between two layers 103,105 of carbon fibre composite. A recess 106 is moulded into a curved area of the panel 171, with a floor 107 and walls 108 substantially as for the first 101 and second 131 bodywork panels. Here, it can be seen how the floor 107 follows the local contours of the bodywork panel 171, and a correspondingly curved display screen module (not shown) will be needed to fill the recess 106 and blend in physically with the outer surface of the bodywork panel 171.

Figure 24:
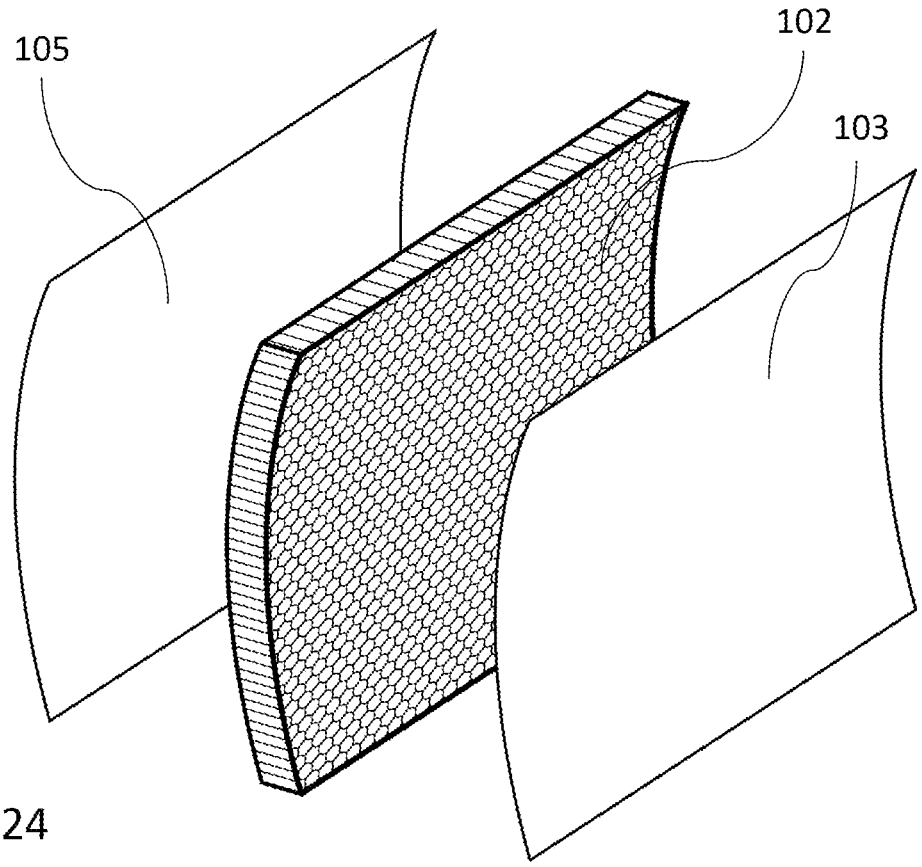
FIG. 24 is an exploded schematic perspective view of the structure of a standard bodywork panel.
Figure 25:
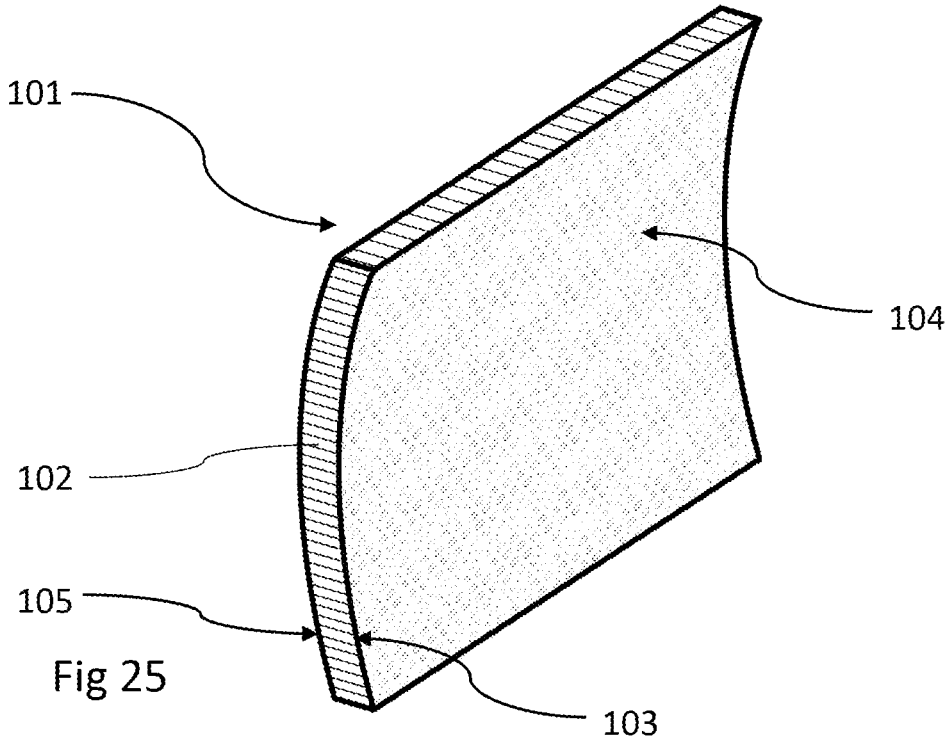
FIG. 25 is an assembled schematic perspective view of the standard bodywork panel of FIG. 24.

FIGS. 24 to 28 further illustrate the need for, production and use of the textured film 124. Using the numbering of FIG. 16, FIG. 24 shows the Nomex® honeycomb core 102 in more detail, about to be pressed between the first layer 103 and the second layer 105 of carbon fibre composite. FIG. 25 shows the completed bodywork panel 101. The pressure exerted on the carbon fibre layers 103, 105 against the cells and walls of the honeycomb structure of the core 102 has left the outer surface 104 of the carbon fibre layer 103 no longer smooth, but bearing a definite and visible texture.

Figure 18:
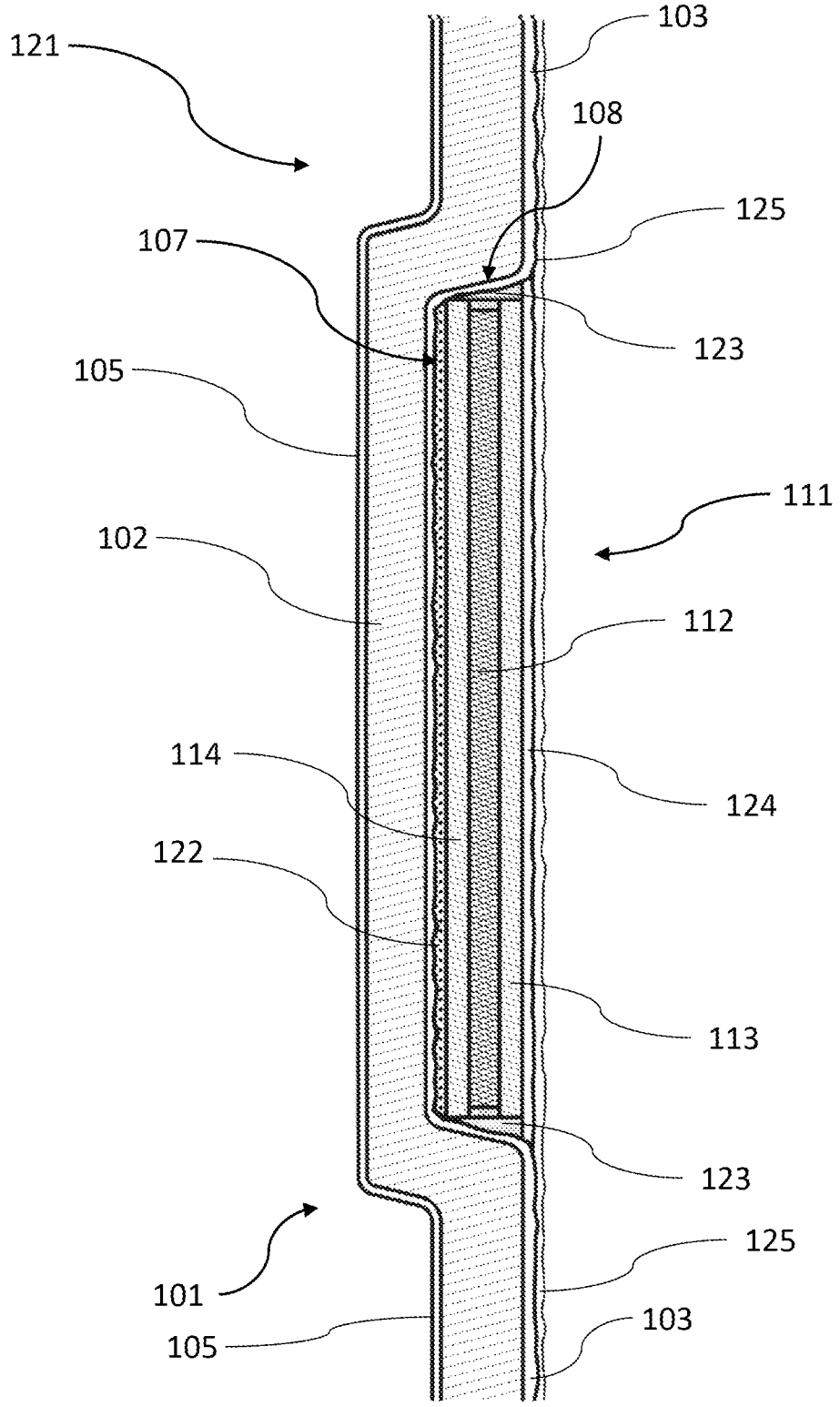
FIG. 18 is a cross section of a bodywork element embodying the present invention with the display screen module of FIG. 17 mounted to the bodywork panel of FIG. 16.
Figure 26:
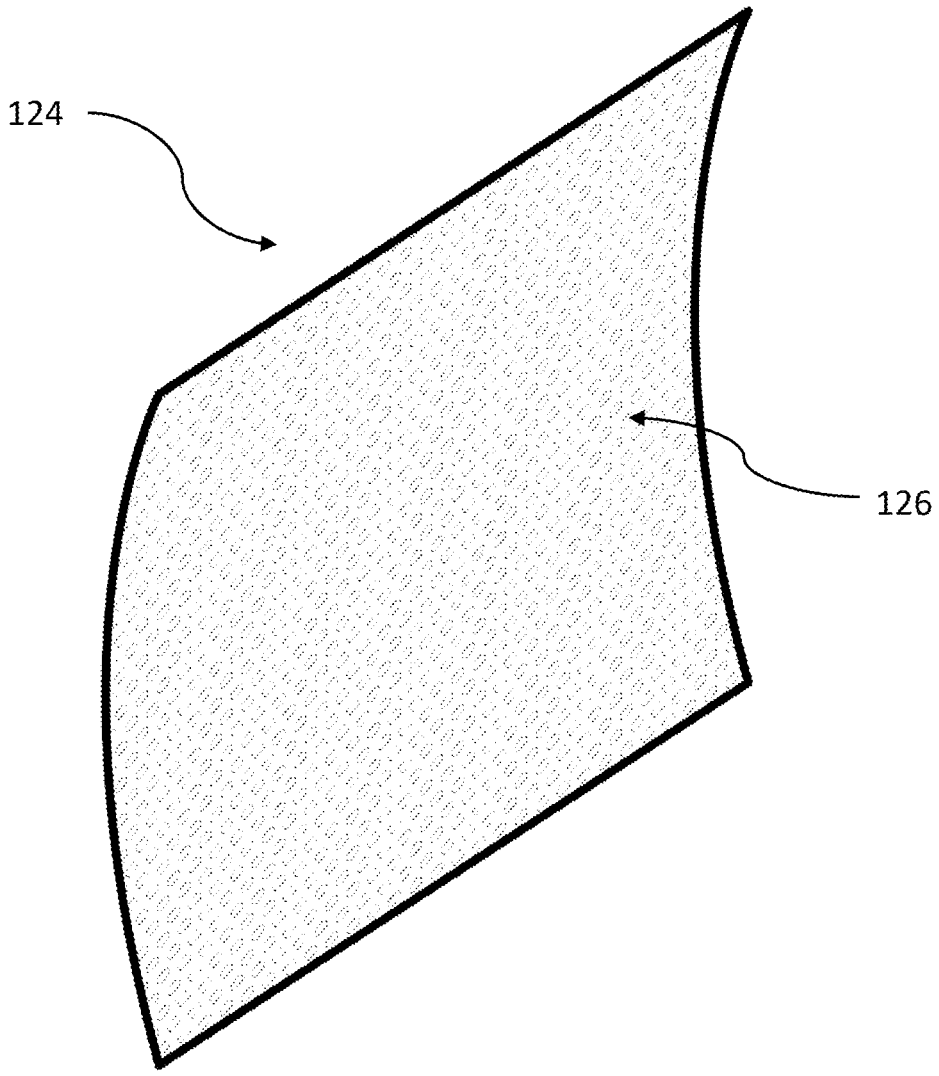
FIG. 26 is a schematic perspective view of a piece of textured film as used in the present invention.

FIG. 26 shows a piece of clear textured vinyl film 124, as used in FIG. 18, extending across an entire outer face of the display screen module 111. The film 124 has one plain reverse face (not shown) for optimum optical contact with the outer layer 113 of the display screen module 111, but its other, obverse face 126 is textured to match the texture formed on the outer surface 104 of the carbon fibre layer 103 of the bodywork panel 101.

Figure 27:
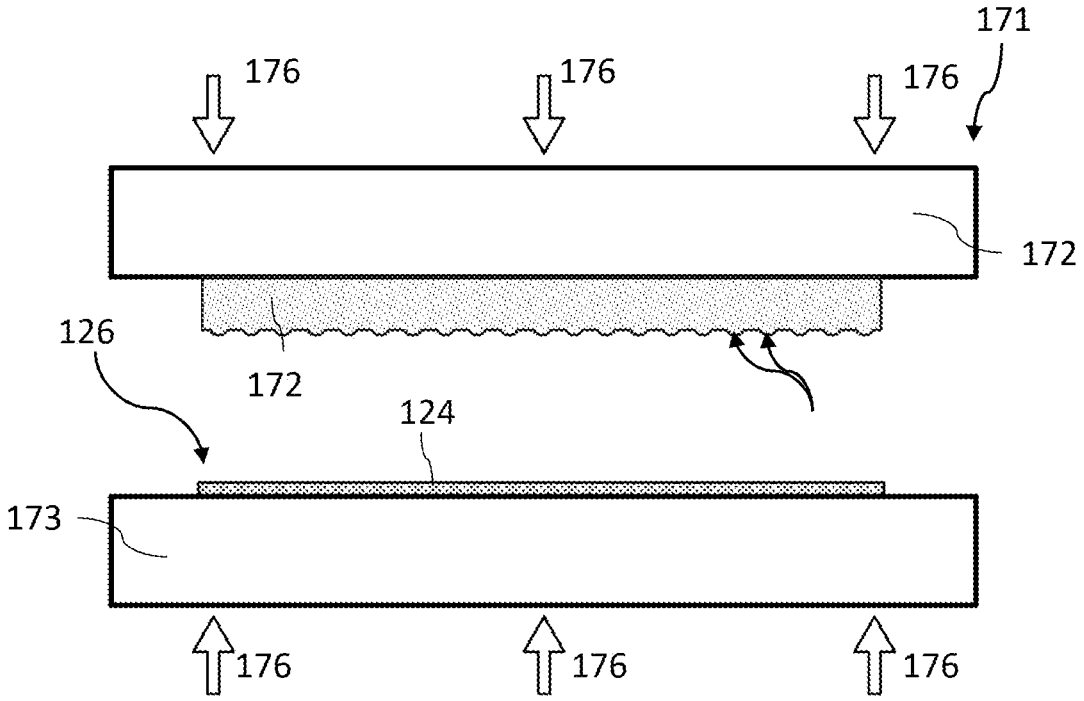
FIG. 27 is a schematic side elevation of a heated press for producing the textured film of FIG. 26.
Figure 28:
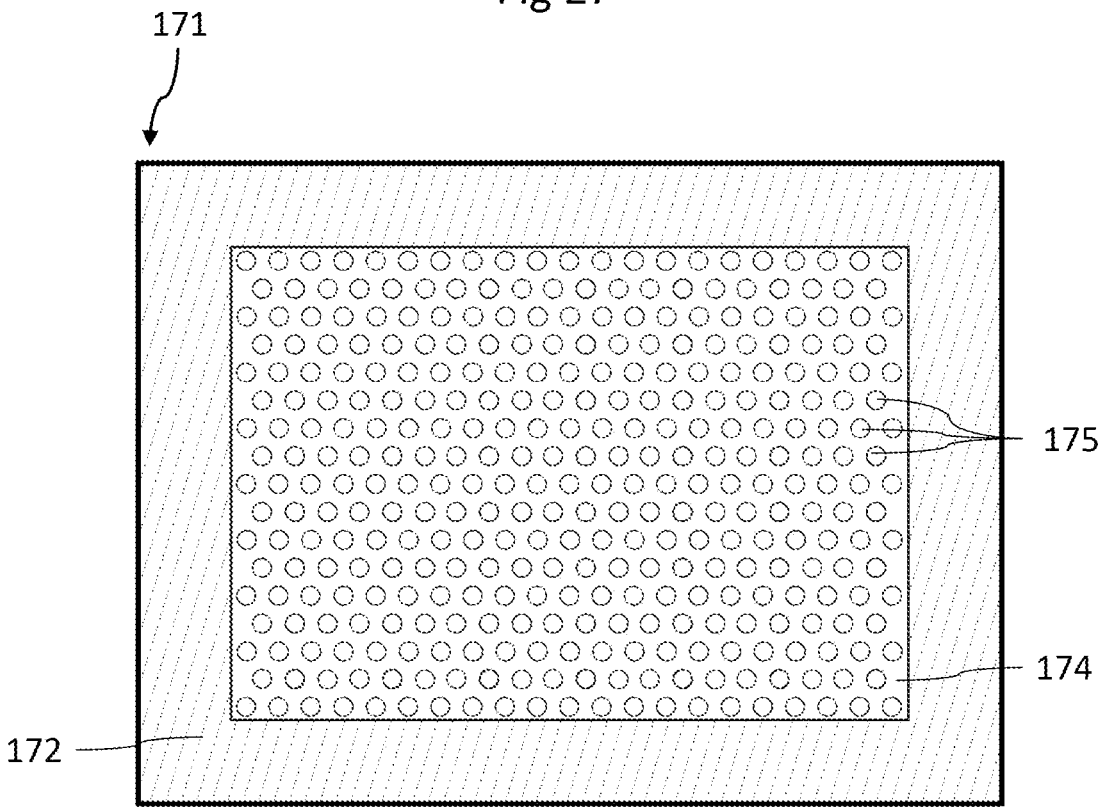
FIG. 28 is a plan view of a mould plate from the press of FIG. 27.

The clear textured vinyl film 124 is produced using an apparatus and method represented in FIGS. 27 and 28. A press 171 comprises opposed upper 172 and lower 173 heated press plates. A piece of clear vinyl film 124 is located on the lower press plate 173, aligned with a polished metal mould plate 174 mounted to the upper press plate 172. The mould plate 174, as shown in profile in FIG. 27 and in plan view in FIG. 28, bears a pattern of raised bumps or humps 175, corresponding in arrangement, spacing and size to the texturing formed by pressure of the outer carbon fibre layer 103 against the honeycombed core 102 of the bodywork panel 101.

Thus, when the press plates 172,173 are heated (heating the mould plate 174 and the piece of film 124 respectively), and the press plates 172,173 are compressed together by a pressure represented by arrows 176, the obverse face 126 of the film 124 is stamped with a pattern of recesses that closely simulates the texturing of the bodywork panel 101.

The textured film 124 can be pre-cut to fit a particular display screen module 111 before pressing, or a larger sheet of the film 124 can be pressed first, and then trimmed to size.

FIGS. 29 to 32 show a currently preferred approach for blending-in a display screen module 111 visually with its surroundings. It is desirable for the join between the display screen module and the surrounding bodywork not to be visible, so that a logo or other image can be displayed on the flexible display screen 112 of the module 111, with an image background having the same colour as the adjacent bodywork, producing the effect of the logo or other image being painted in the middle of a continuous bodywork panel.

Figure 29:
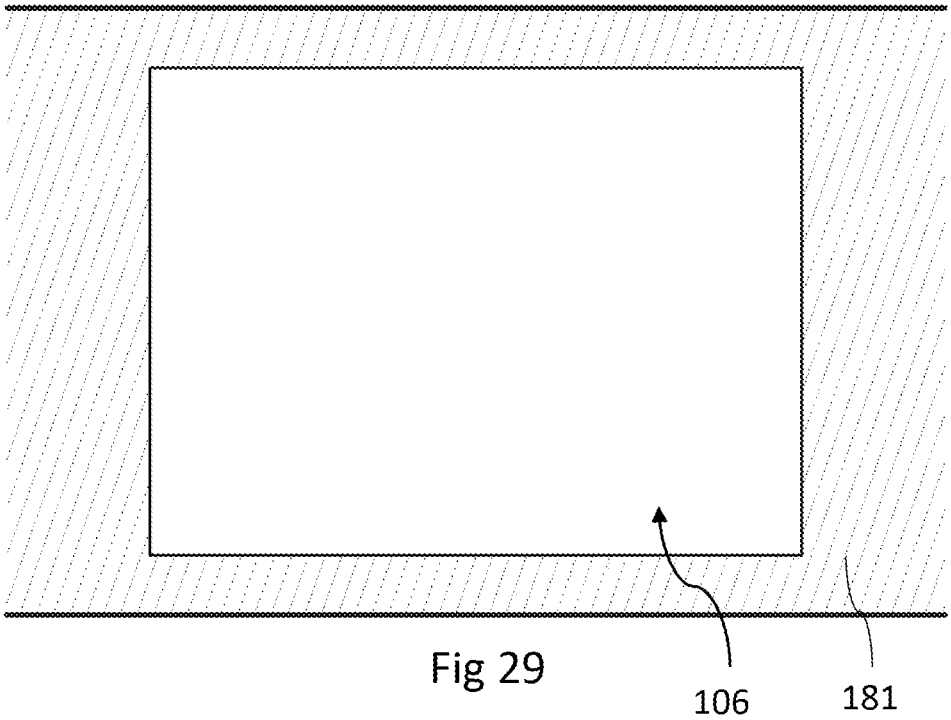
FIG. 29 is a scrap side elevation of a bodywork panel of the present invention.

In FIG. 29, a fifth bodywork panel 181 of the invention is shown, which has a shallow recess 106 formed in it, substantially as for the other bodywork panels 101, 131, 151, 171 described and shown above (the walls 108 are omitted for clarity).

Figure 30:
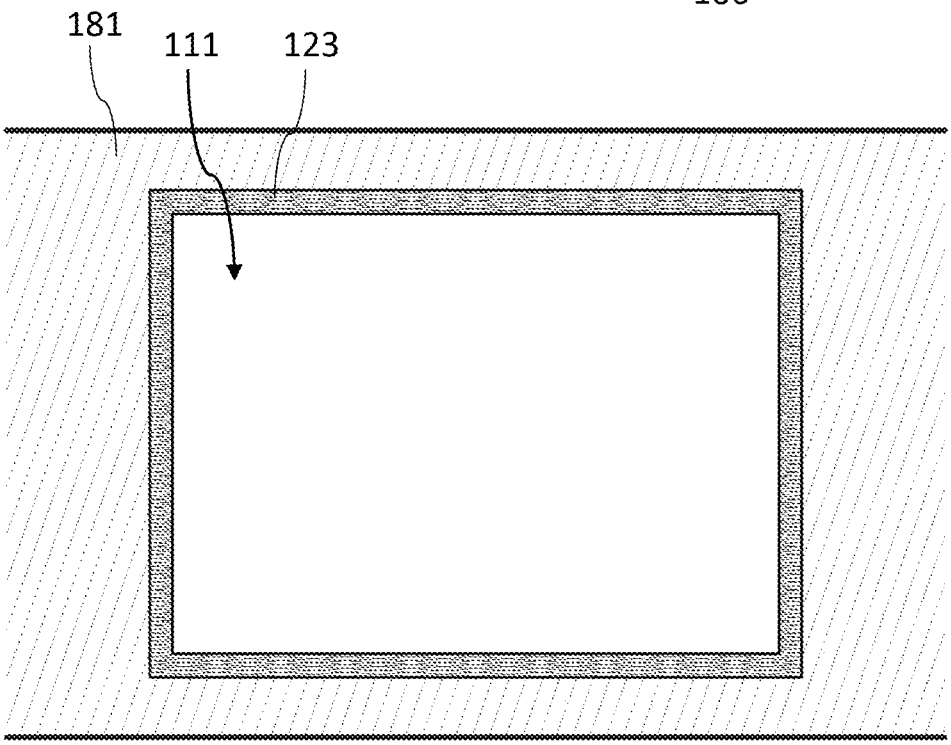
FIG. 30 is a scrap side elevation of the bodywork panel of FIG. 29 with a display screen module of the present invention fitted.

In FIG. 30, the display screen module 111 has been fitted into the recess 106, and a thin strip of filler 123 has been run around its outer edge to fill in the gap between the module 111 and the bodywork panel 181 (thickness of the filler strip 123 is exaggerated for clarity). Thus, it can be seen that however well a background colour of the display screen module 111 matches the colour of the bodywork panel 181, it will be obvious that there is something implanted into the bodywork 181.

Figure 31:
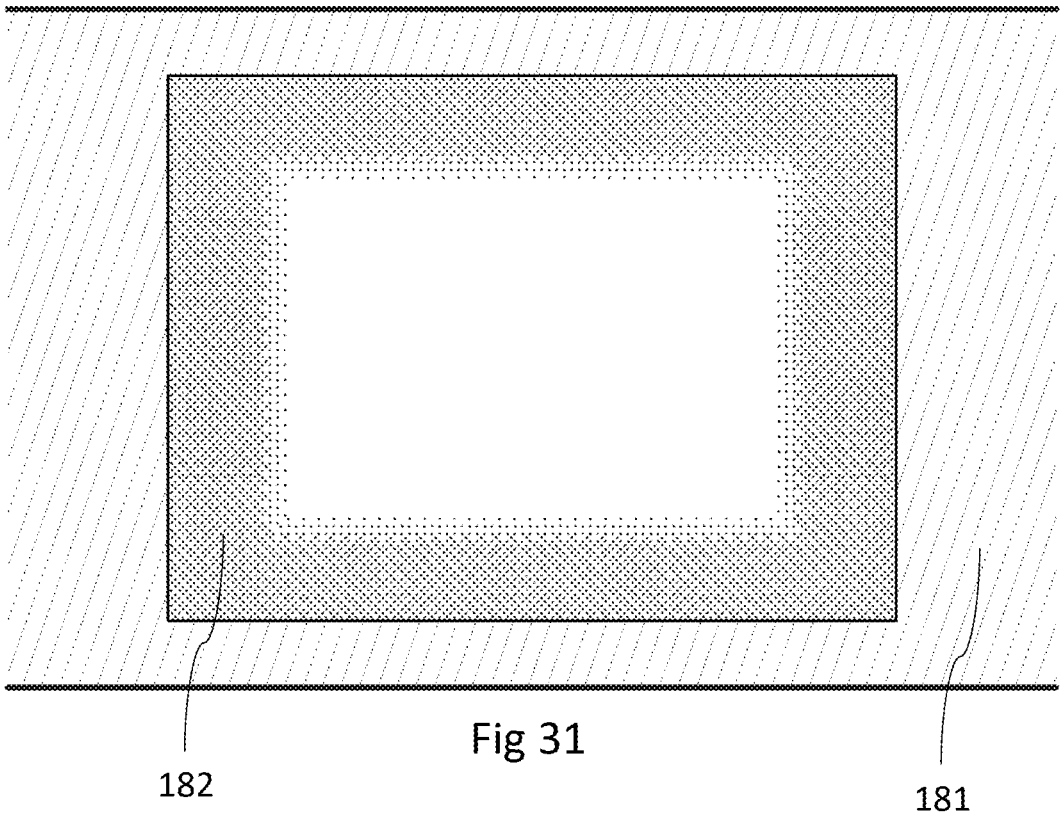
FIG. 31 is a scrap side elevation of the bodywork panel of FIG. 30 with a sheet of vinyl film covering the display screen module, forming a bodywork element embodying the present invention.

In FIG. 31, a vinyl cover sheet 182 has been applied, extending across the entire display screen module and (in this case) across an adjacent zone of the bodywork panel 181 extending a short distance to every side of the module 111.

Figure 32:
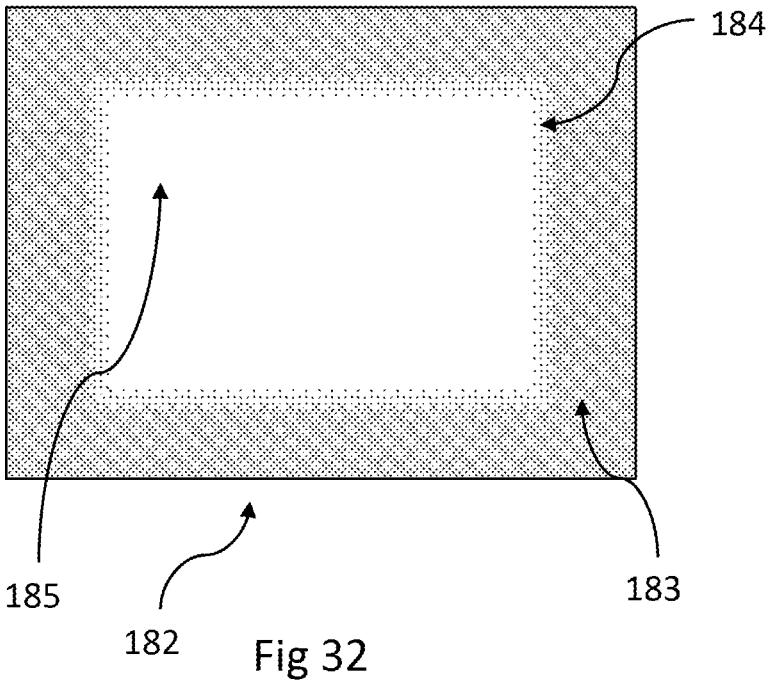
FIG. 32 is s plan view of the sheet of vinyl film of FIG. 31.

The rectangular vinyl cover sheet 182, shown in isolation on FIG. 32, has a peripheral zone 183 extending along all four sides, which is opaque and is the same colour as the surrounding bodywork panel 181. In use, this covers the filler 123 and a peripheral area of the module 111, as well as the adjacent zone of the bodywork panel 111. A central zone 184 of the vinyl cover sheet 128 is wholly clear, so that the image on the display screen 112 of the module 111 cam be seen. A transitional zone 185 of the cover sheet 182, extending between the opaque peripheral zone 183 and the clear central zone 184, has a gradation in opacity (still the same colour) such that its junctions with both the peripheral zone 183 and the central zone are imperceptible. This has the result that it is impossible to distinguish where the bodywork leaves off and the display screen module begins, even if the colour matching between the background of the display screen and the bodywork is not perfect.

The cover sheet 182 can have the opaque peripheral zone 183 and the gradated transitional zone 185 applied by painting or printing, on either face; pigmentation of the vinyl film itself would be possible but more difficult to control. In the past, vinyl film "stickers" have been queried because of removal problems and because of the steps possibly produced at their edges. However, in this case, the cover sheet will be left in place for long periods, since the images can be changed without touching the cover sheet. Also, as referred to in the context of FIG. 18, a clear, thin outer vinyl sheet can be applied to the bodywork element last of all, hiding or at least softening unwanted contours of the surface. While these added vinyl films may add to overall weight, this will be no worse than the extra weight from the display screen module, its control unit and their power supplies, and given the improvements produced in image display, wholly acceptable.

Also, most racing cars have a livery design with multiple stripes or streaks of contrasting colours, often running fore and aft along the bodywork (even Ferrari varies from overall bright red at times). Developments of the vinyl cover sheet 182 can be used in conjunction with these features of the bodywork design, both to aid concealment of the display screen module 111, and to improve definition of the bodywork colour scheme.

Figure 33:
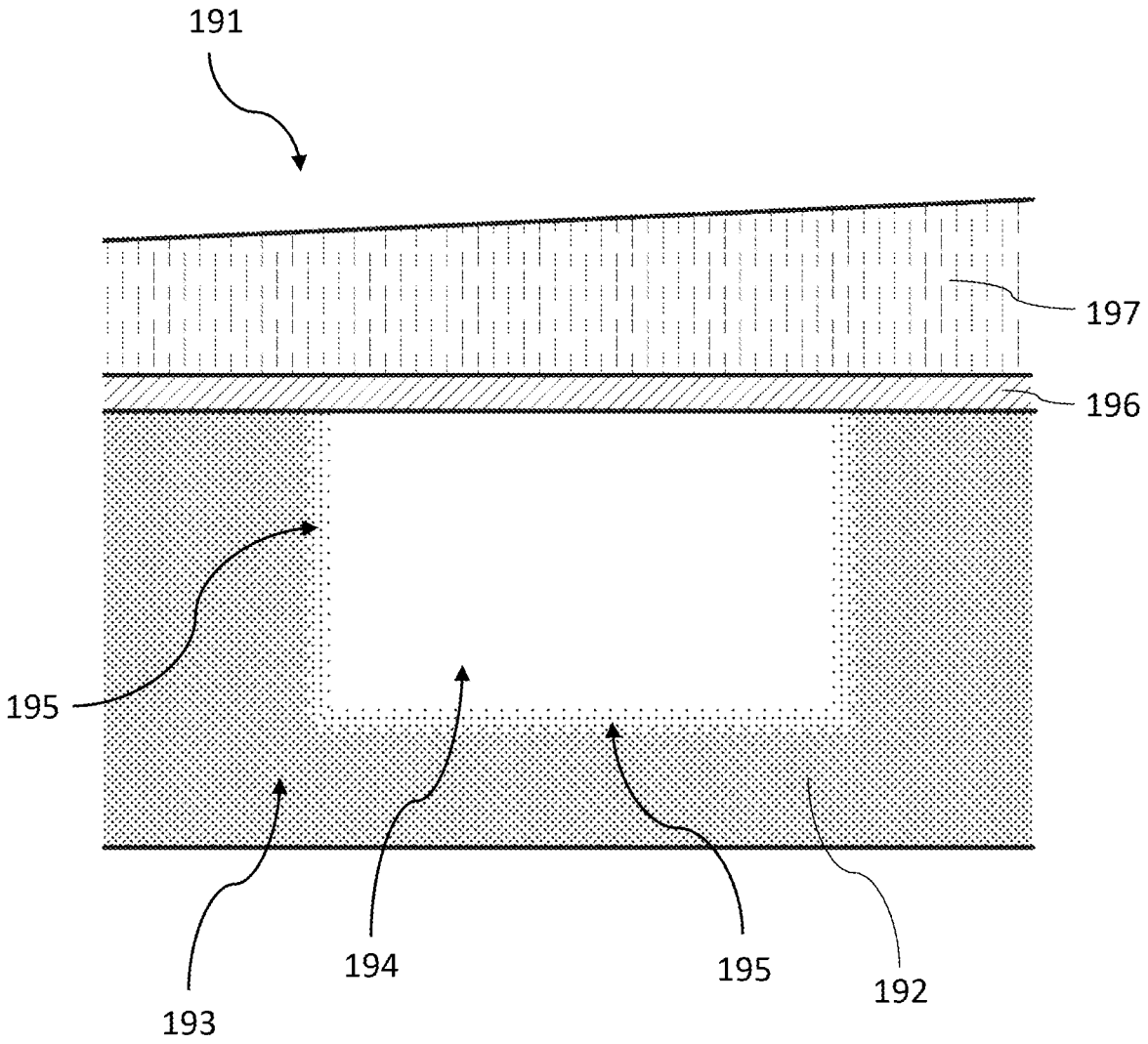
FIG. 33 is a scrap side elevation of a sixth bodywork element of the present invention.

For example, in FIG. 33, part of a sixth bodywork element 191 has a three-colour finish, made up of three vinyl film strips, 192, 196, 197, and an implanted display screen module (not visible). The lowest vinyl film strip (and the widest) 192 has an opaque coloured zone 193, a clear zone 194 and a transitional zone 195 of smoothly gradated opacity, the opaque coloured zone 193 forming most of its area, extending as far as front, rear and lower edges of the bodywork element 191. Along its upper edge, the lowest strip 192 meets the middle strip 196 along a sharply distinguishable junction—the middle strip 196 will usually be of a distinctly different colour, for example forming a "coach line" in gold, silver or white. The third, uppermost strip 197 extends from the middle strip 196 to cover a uppermost portion of the bodywork element 191.

The point here is that the display screen module is located such that its upper margin coincides with the sharp junction of the lowest strip 192 and the middle strip 196. Thus, there is no need to conceal its upper margin. The clear zone 194 extends at its upper extremity as far as the junction with the middle strip 196, and the transitional zone 195 only has to be screen printed/painted along three sides of the clear zone 194. The controllable image on the display screen module can still be arranged well within the clear zone 194, appearing to be within a continuously-coloured lowest stripe 192 of the colour scheme of the bodywork element 191.

Figure 34:
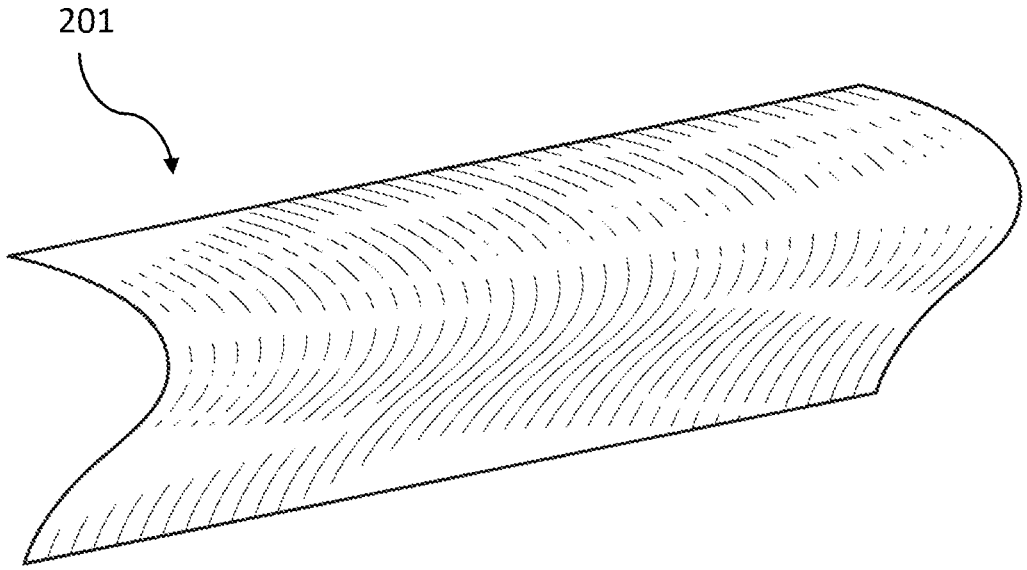
FIG. 34 is a perspective view of a conventional bodywork panel.
Figure 35:
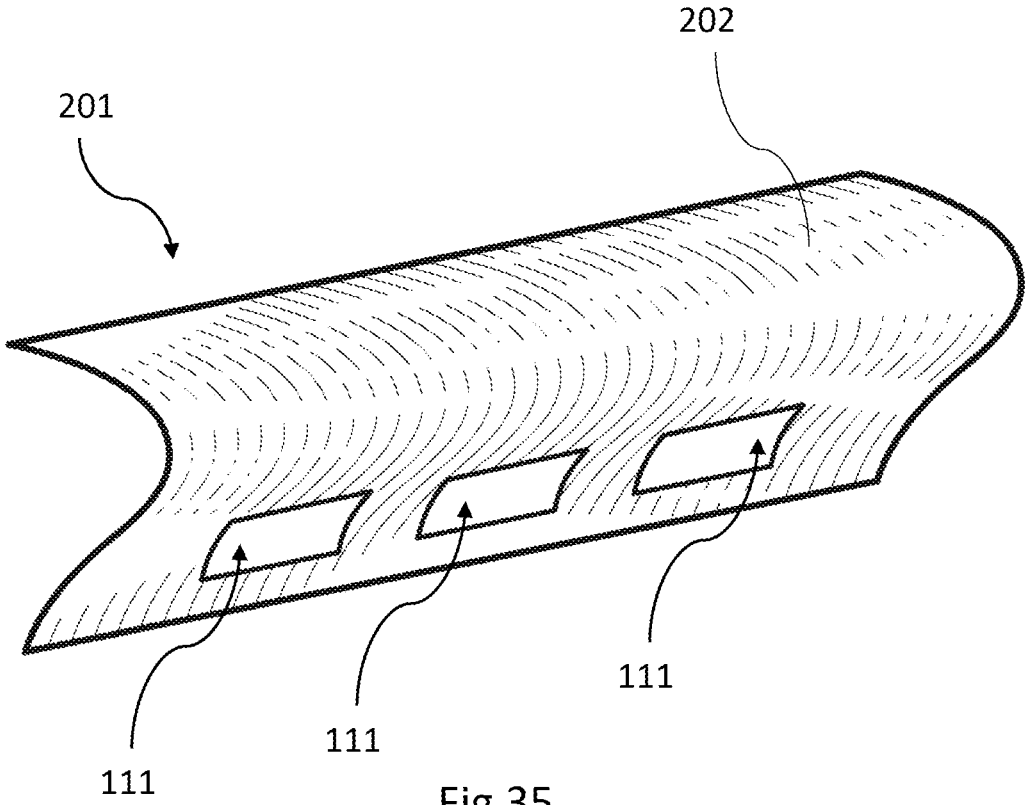
FIG. 35 is a perspective view of a bodywork element embodying the present invention, finished in a first manner.

Further examples of achievable bodywork layouts are shown in FIGS. 34 to 37. FIG. 34 shows a full conventional side panel 201 from the bodywork of a Formula racing car. FIG. 35 shows the side panel 201 with three recesses having been formed, each containing a display screen module 111; alternatively, it could have three clear panels inserted in corresponding apertures, with display screens mounted behind them, as disclosed in GB1909397.0 and PCT/GB2019/000091. In either case, a full vinyl covering 202 in a desired colour scheme extends across the whole side panel 201. Desirably, blending arrangements around clear zones in the vinyl covering 202 are present to coincide with each module 111 or clear window, along the same lines as in FIGS. 29 to 32, but they would be hard to distinguish at this scale.

Figure 36:
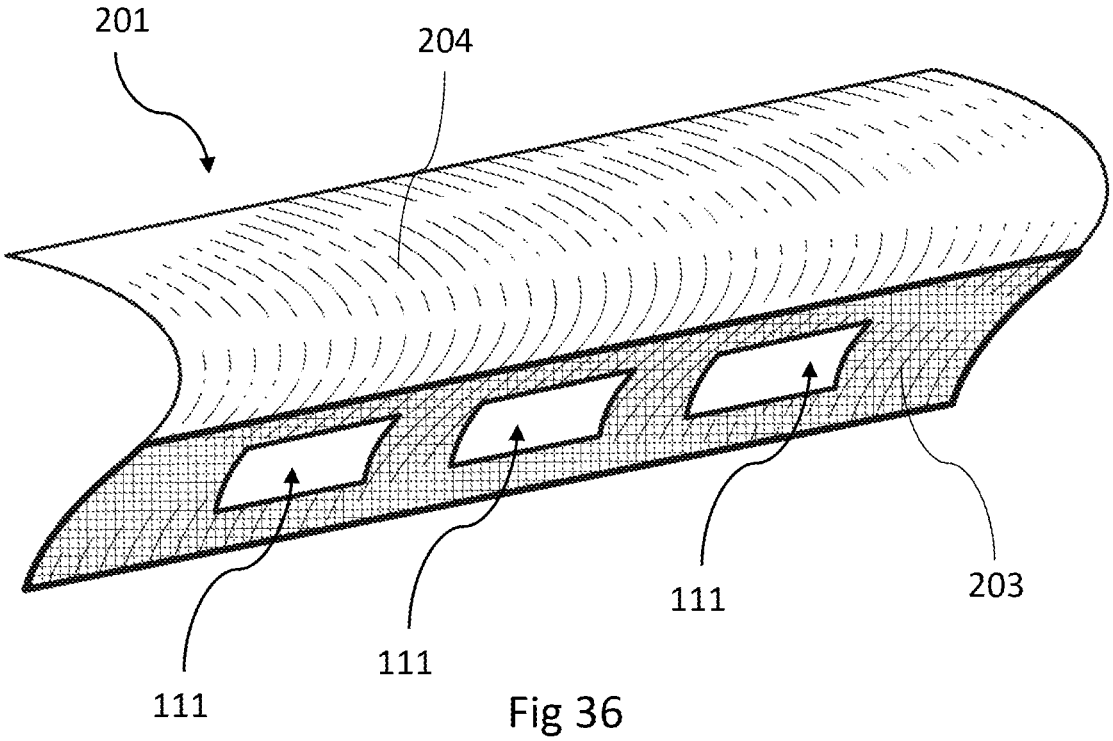
FIG. 36 is a perspective view of the bodywork element of FIG. 35, finished in a second manner.

In FIG. 36, the same recesses/display screen modules 111 or clear windows are present, but a panel 203 of a particular livery colour extends along the side panel 201 surrounding the modules 111/clear windows. The covering 202 is reduced to an upper cover 204, covering the upper curves of the side panel. The same effect could be produced from a full vinyl covering 202 with a sharply differentiated colour scheme printed or painted to it in its lower regions.

Figure 37:
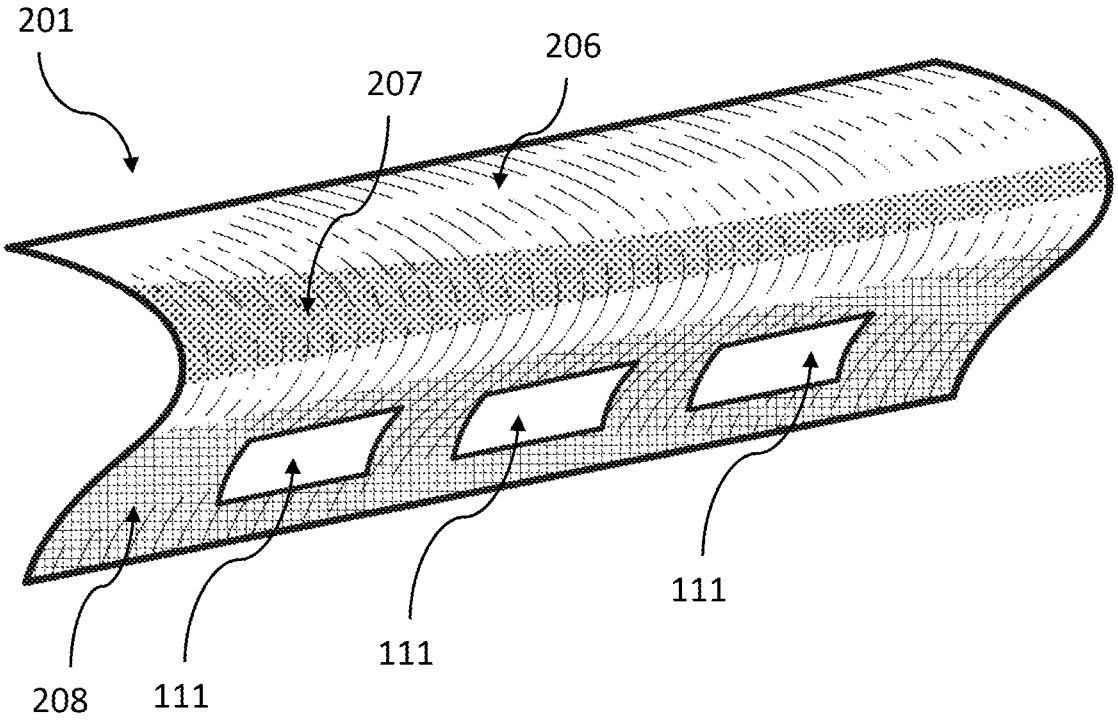
FIG. 37 is a perspective view of the bodywork element of FIG. 35, finished in a third manner.

In FIG. 37, the same recesses/display screen modules 111 are again present, but a single full vinyl covering 206 is used, bearing two distinct, differently-coloured stripes 207, 208.

Thus, there are a wide range of economic and effective systems in the present invention that allow the display of images that appear to be seamlessly present within a painted area of bodywork, yet can be altered at will. This permits their use as part of a sponsorship or advertising deal, such that selected images can be displayed at different positions on the track or under different race conditions, or any other commercially desirable conditions.

Each of the arrangements shown in the Figures thus allow images of choice, typically advertising logos or the like, to be displayed as if painted on the bodywork panel 13,101, 131,151,171,181 while allowing the images to be changed as often as desired. While this could be used, for example, to display car performance data to spectators, the main use of this facility is likely to be advertising and sponsorship logos, as will be described below.

The images displayed and changed using the arrangements described about can be simple logos or more complicated images including text, although they will mainly be viewed at a distance and on a fast-moving vehicle, so the level of detail that is worthwhile may be limited. Similarly, moving images would technically be possible, but their usefulness would depend on how far movement of the image could be discerned by a viewer.

As a general rule, the images will be generated so that they have a background to the logo, text, etc, which corresponds in colour to the paint finish of the respective bodywork panel. Thus, the logo, text, etc will appear to be applied over a continuous background extending over the whole bodywork element. As noted above, the paint finish of the bodywork panel is feathered inwardly around the margin of the inset panel, further concealing the edges of the aperture, the inset panel and the display screen, and further enhancing the illusion that the inset panel and display screen are a continuous part of the bodywork element.

The scale of the right to display an advertisement on a display screen on a car could be structured in several different ways. Advertising space could for example be sold for fixed 10 minute or 20 minute slots during the standard 2 hour maximum duration of a Grand Prix race. The start and the finish of the race are most likely to draw attention, especially for TV viewers, and so slots at these times might have a higher cost, or might be of shorter duration for the same cost. A further approach would be to sell a particular display location for the entire race, but only as a default, with another advertiser being able to substitute its own advertisement for a selected period if it paid a higher rate. In versions of the technology where the advertisement to be shown is controllable from a remote server, a live auction of time slots and locations on the car could be carried out during the race. A variation of this would have the current highest bidder's advertisement shown, until such a point that its bid was beaten.

There would be other desirable stages of the race for showing advertisements. Currently, Formula 1 rules require cars to make at least one pit stop during the race, during which the car will be stationary for several seconds, and TV camera angles are already set-up. Thus, some advertising spaces can be guaranteed good visibility during a pit stop. Either an operation monitoring the race could use the remote server system to switch to the advertisement that had been booked for pit stops at the appropriate time, or an external trigger could be used. (For pit stops, there are electronic arrangements at the entry and exit of the pit lane, used to regulate speeds in the pit lane for safety's sake—this could be used to trigger an-on-board display controller to switch to a particular advertisement from entry into the pit lane until the car re-enters the track). Periods when the race cars are not at maximum speed, such as when a safety car is out or when the race cars are operating under the "virtual safety car" system, could also be sold at premium rates, because of the greater visibility of the advertisements on a slow-moving vehicle. Again, this could be controlled by an operator via the remote server, or the signals used to indicate e.g. virtual safety car conditions could be used to trigger on-board display controllers to show different advertisements.

If desired, mathematical algorithms could be programmed into the remote server and/or the on-board display controller (s) to produce changes of advertisement according to a more complex set of rules, or perhaps combining several of the above control criteria.

The advertisements themselves will need to be approved as suitable before they can be loaded into the remote server or the on-board display controllers. Initially, this would be carried out by human staff, although in time, computer programs or artificial intelligence systems could automate this step.

As mentioned above, the display screens could also be used to display vehicle data to spectators, although not on the level of detail provided to a race-cars pit crew by existing telemetry systems. Since this would prevent the same screen being used for advertising, however, this approach would probably be limited in use—maybe to brief intervals between advertisements, or only when there is unusual data to be "reported".

While the invention has been described above in terms of motor car racing, it is equally applicable to motor cycle racing, particularly track racing, such as MotoGP or Superbike racing (Note: MotoGP is a registered trade mark of Dorna Sports SL). Racing motorcycles have a streamlined cowling around the handlebars, and fairings at the front of the body; above the front wheel and in front of the front forks; in front of the rider's legs; around the fuel tank; and a small fairing at the tail. These are all typically made from sheet carbon fibre composites, similar to those used for motor racing cars.

The display of advertising and sponsorship are just as important to motorcycle racing as they are to motor car racing. As a result, the display panel arrangements described above for installation into the bodywork of racing cars could be incorporated into the cowlings and other bodywork of racing motorcycles, with the same features and benefits.

Figure 11:
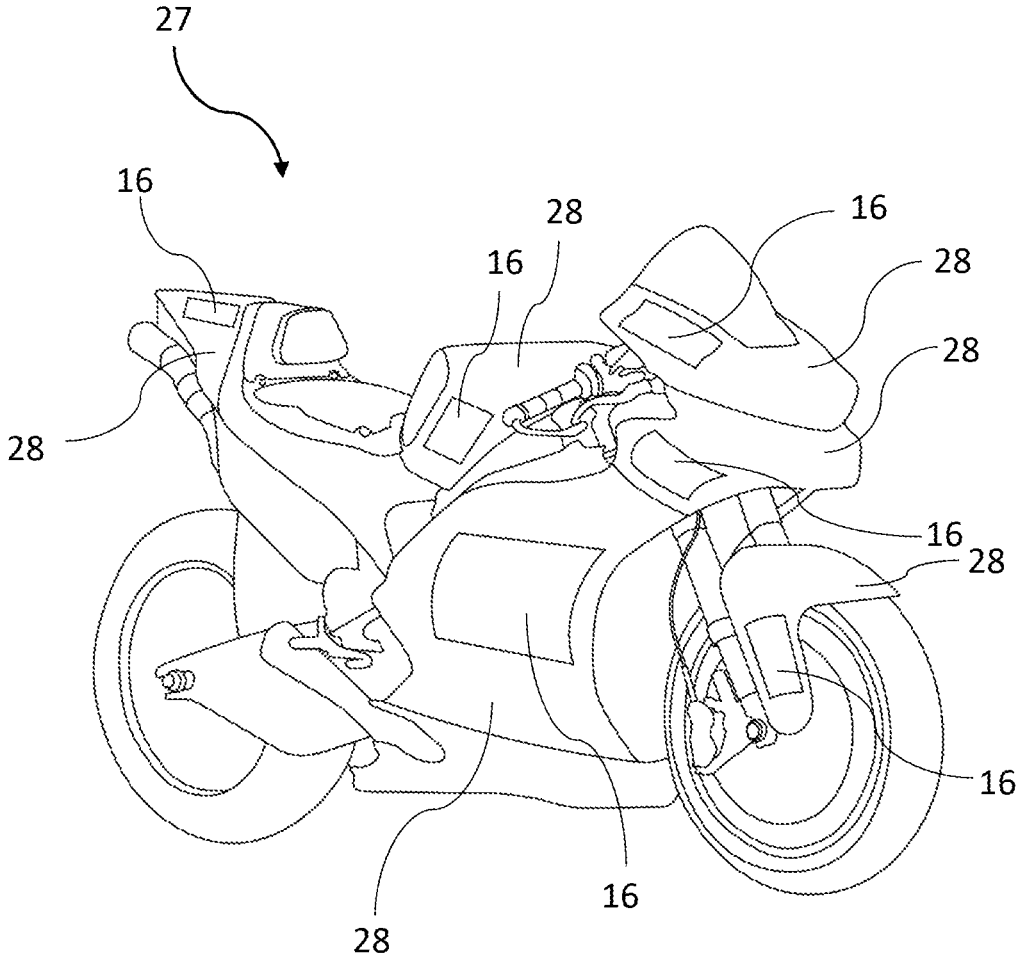
FIG. 11 is a perspective view of a racing motorcycle fitted with display screens embodying the present invention.

FIG. 11 shows a typical track racing motorcycle 27. In this example, each of the larger, more visible cowlings, fairings or other bodywork panels 28 has been fitted with an optically clear panel 16, shaped to follow the profile of that particular bodywork panel 28. Behind each optically clear panel 16 is mounted a display screen arrangement such as one of those shown in FIG. 7, 8, 9 or 10 above, for use on racing cars. Exactly the same control arrangements can be used as described above for motor racing cars, displaying controllably changeable graphics behind each of the clear panels 16, as desired.

There is however, a small drawback, in that the overall surface area of a motorcycle available for display of advertising and sponsorship material in this way is quite small, relative to a racing car. Formula 1 bodywork almost totally encloses the car's driver, and a NASCAR driver is entirely within the car's body, while a motorcycle rider has much of his or her body fully or partially outside the bodywork of the motorcycle, effectively forming part of the aerodynamic surface of the motorcycle when crouched down at speed. Thus, the available space on motorcycles for the display panels as described for racing cars is not high.

Currently, this lack of space on the motorcycle itself is made up for by applying a great deal of sponsorship and advertising material to the rider him- or herself. Racing motorcyclists wear suits of protective clothing, which customarily bear copious amounts of this material on any surface that will be visible to the spectator, either in the normal crouching racing stance or when sitting up on the motorcycle—the classic winner's pose, for example, being a perfect photographic shot to display logos emblazoned across the rider's chest that would be hidden during the race.

This protective clothing is referred to as "leathers", and much of it is indeed still made from leather. It currently consists of boots, gloves and a one-piece full body suit, an example of which is shown in FIGS. 12A and 12B.

The leathers 30 are mainly made up of shaped panels 31 of leather, stitched together. The leathers 30 must allow the rider freely to change position and balance on the motorcycle, while providing protection if the rider comes off the motorcycle, potentially sliding and scraping at great speed across the track surface, or tumbling and rolling across the track and surrounds, depending on the exact circumstances of their departure from the motorcycle. Leathers 30 are hence constructed as a compromise between protective strength, toughness and stiffness on one hand, and comfort and flexibility on the other. At the professional level, leathers 30 are individually fitted to the rider, both for comfort and for aerodynamics.

Current advertising material is incorporated into the leathers permanently, a change of advertiser requiring the complete replacement of the leathers by a set with the new advertiser's graphics applied. This is time consuming and inconvenient. Advertising material still cannot be changed during a race, as there is nothing like enough time at any stage for the rider to change into a fresh set of leathers.

Figure 12B:
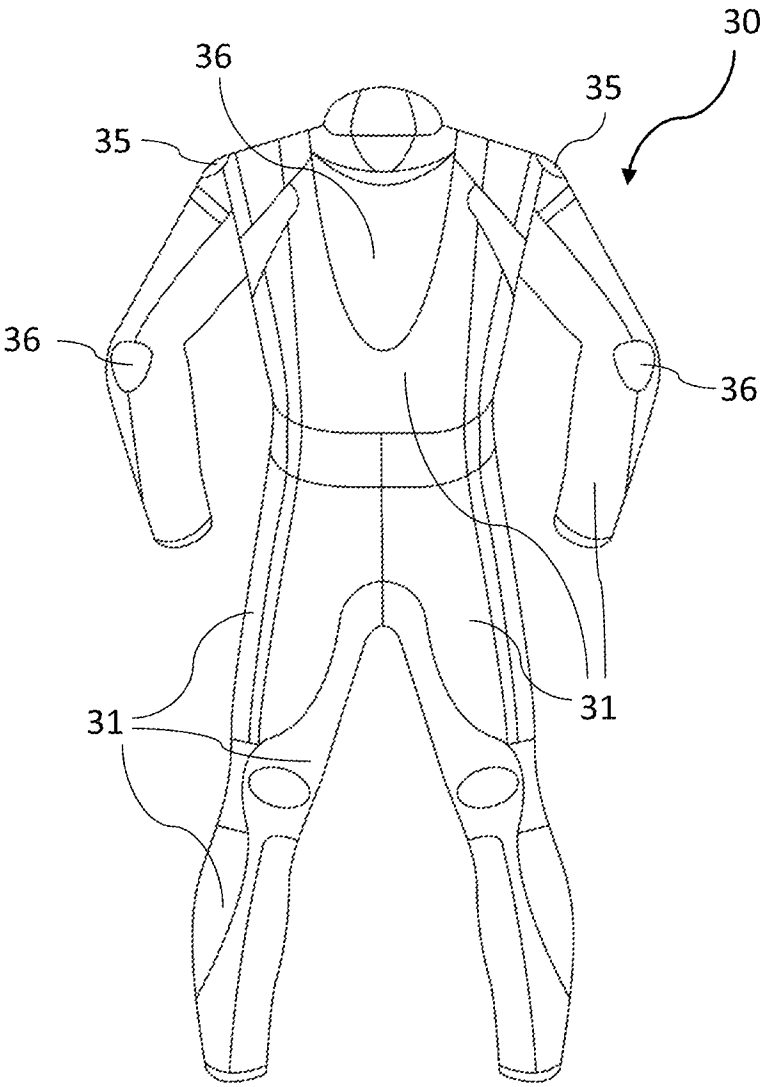
Fig 12B PRIOR ART
FIGS. 12A and 12B are front and rear elevations respectively of a typical set of motorcycle racing "leathers"
Figure 12A:
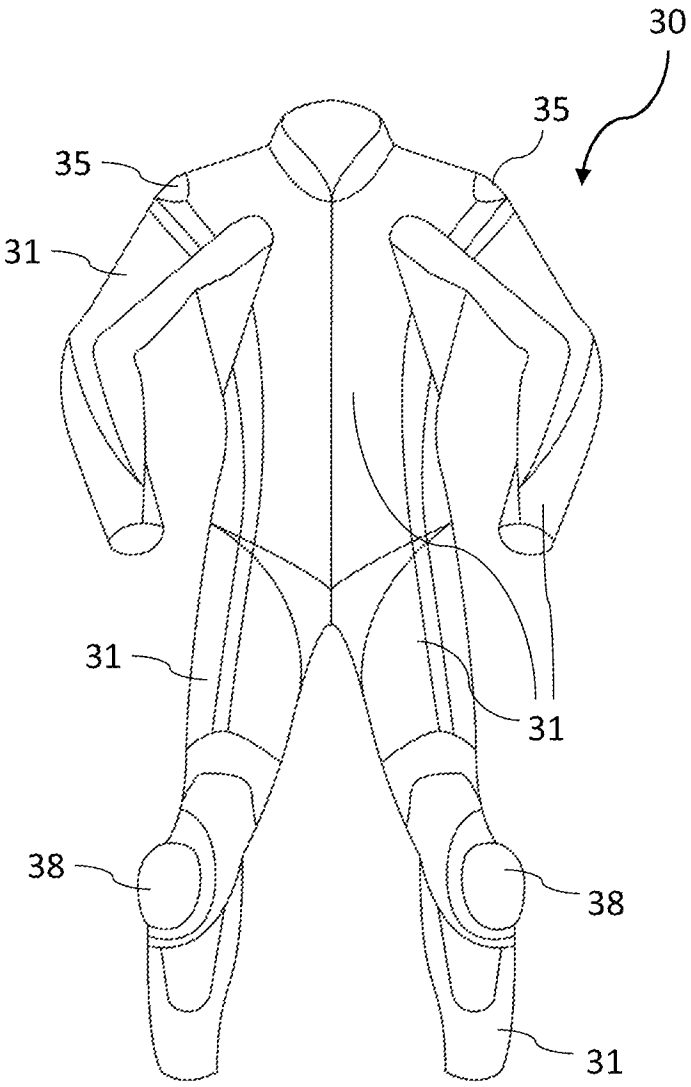
Fig 12A PRIOR ART

As shown in FIGS. 12A and 12B, most of the leathers 30 are made up of shaped leather panels 31 which are stiff enough to provide a modicum of ground impact protection and tough enough to protect against track surface abrasion (also known as "road rash"). There are also rigid reinforcing bodies 35, 36, 38 at strategic points on the leathers 30, such as at the point of each shoulder 35, at each elbow 36, and a large solid boss below and to the outside of each knee 38.

Racing leathers 30 have one further feature, a rigid aerodynamic hump 39, located on the rider's back, below the neck and extending from the shoulder blades, down the back, partway to the waist. When the rider is in the racing position, crouched over the motorcycle with his or her body almost horizontal and head held right back to see forwards, the hump 39 meets the back of the rider's helmet, forming an almost continuous aerodynamic fairing behind the helmet and avoiding the turbulence that would otherwise form behind a rounded helmet.

Figure 13:
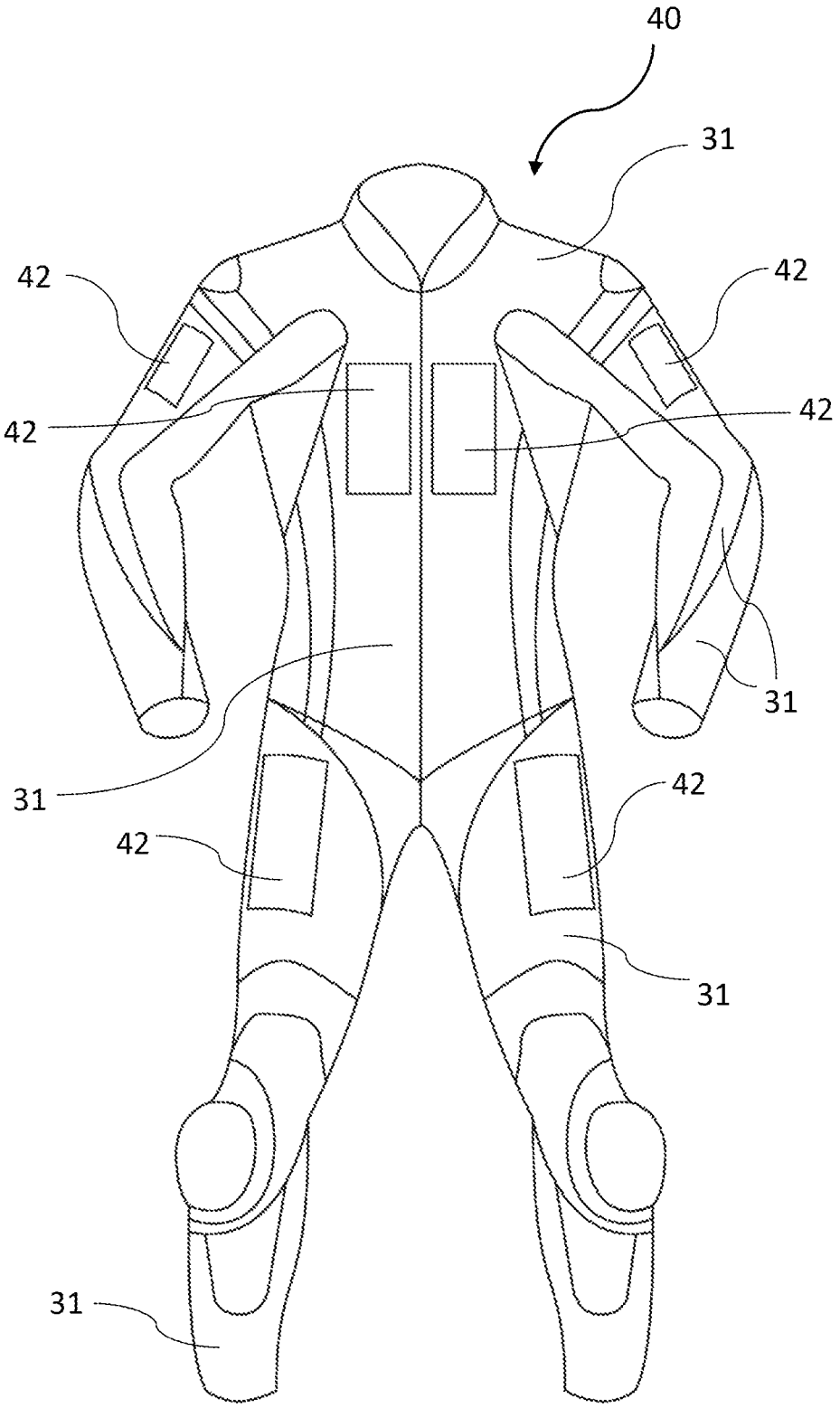
FIG. 13 is a frontal elevation of a set of motorcycle racing leathers showing possible locations of display screens embodying the present invention.
Figure 14:
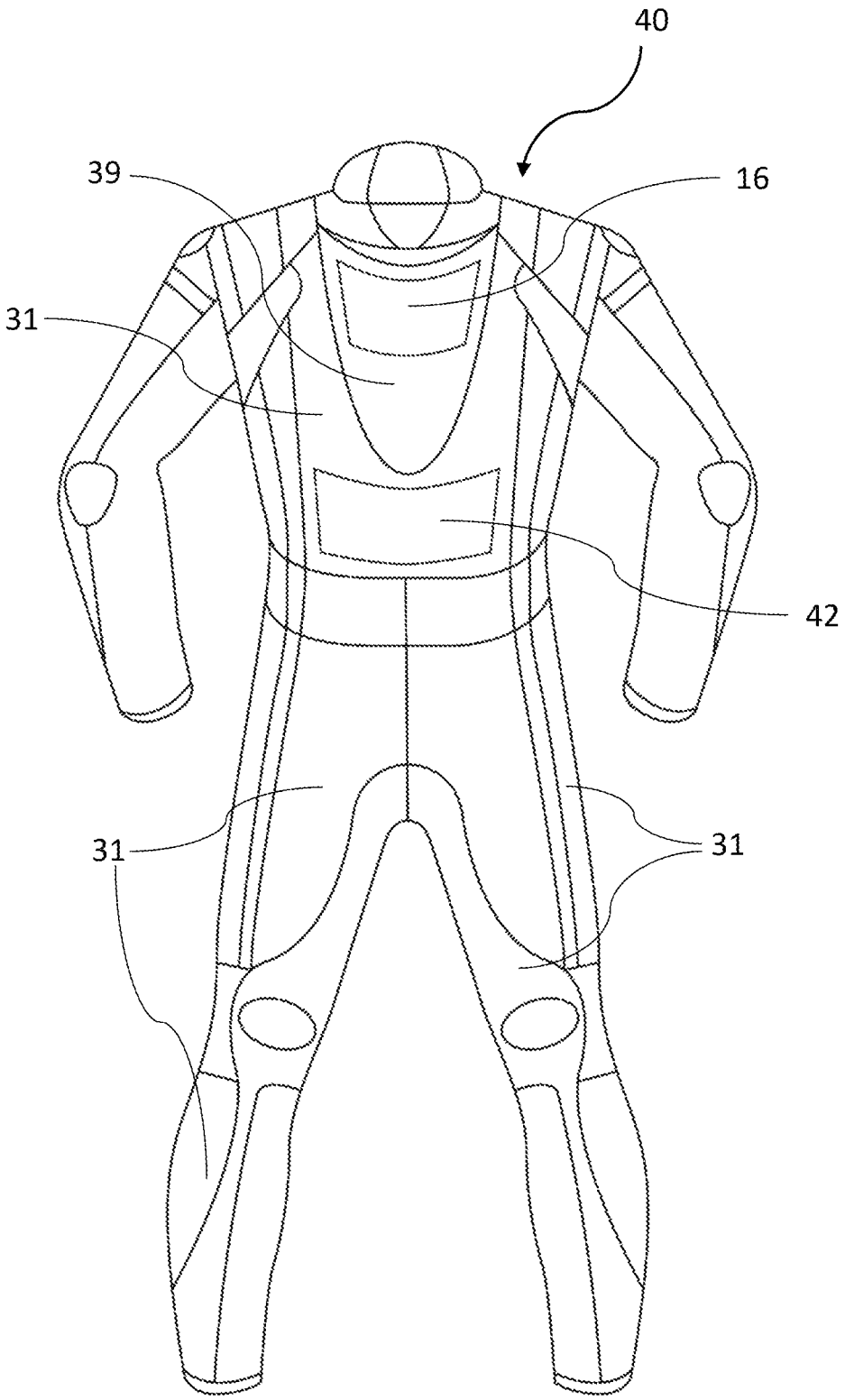
FIG. 14 is a rear elevation of the set of motorcycle racing leathers of FIG. 13, showing further possible locations of display screens embodying the present invention.

This construction allows the incorporation of a display panel system, similar to that described above for racing car and motorcycle bodywork, into a modified set of motorcycle racing leathers 40, shown in FIGS. 13 and 14.

In place of the rigid optically clear panels 16 used in the bodywork embodiments of the present invention, the flexible display screen 17 can be mounted to one side of a sheet of optically-clear flexible plastics 42, using an optically-clear adhesive 18, as in the system of FIG. 7; "vinyl", i.e. plasticised poly(vinyl chloride) sheet, is a suitable option. Instead of forming an aperture 14 as in the bodywork embodiments, the vinyl sheet 42 can be dimensioned to form a margin extending beyond the flexible display screen 17 to each side. This combination can be sewn to an outer surface of the leathers 30 by means of this margin.

It would also be possible to cut an aperture 14 into leather panels 31 of leathers 30, and to insert the optically-clear flexible plastics sheet 42 from within to form a window, with the flexible display screen 17 being mounted to the inside of this window with the optically-clear adhesive 18.

In general, either or both of these options would preferably be used on the portions of the leathers 30 made from stiff leather panels 31, but where some degree of flexibility is expected.

However, on the aerodynamic hump 39, one could use a variant of the display panels shown above incorporated into vehicle bodywork, since the aerodynamic hump 39 is large, substantially rigid and prominent in use during racing. Here, it would be straightforward to incorporate a suitably-profiled optically clear panel 16 into the rigid aerodynamic hump, with the flexible display panel 17 being mounted to its inner face, much as for any of the bodywork-mounted variants described above (see FIGS. 7 to 10).

The interior of the aerodynamic hump 39 is available to hold the display controller 25 and any other electronics and communication equipment that may be required. Indeed, the aerodynamic hump 39 may conveniently be used to hold the display controller 25, etc, for any of the display screen arrangements incorporated into the modified leathers 40, described above.

Thus, suitable display panels can be incorporated in various places on the modified leathers 40, the type of panel depending on the local flexibility needed, and these display panels can be used to display any of the logos, brands, sponsor identification or more factual data that has been described above as being displayed on racing car or motorcycle bodywork.

Figure 15A:
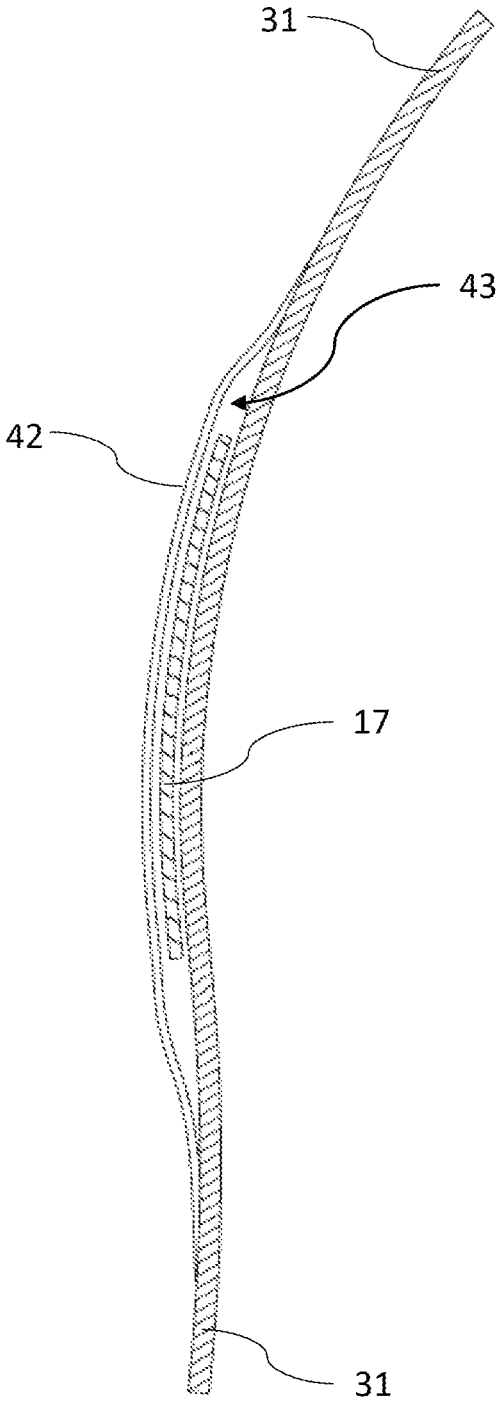
FIG. 15A is a scrap cross-section of a portion of a set of motorcycle racing leathers, fitted with a pocket holding a display screen.
Figure 15B:
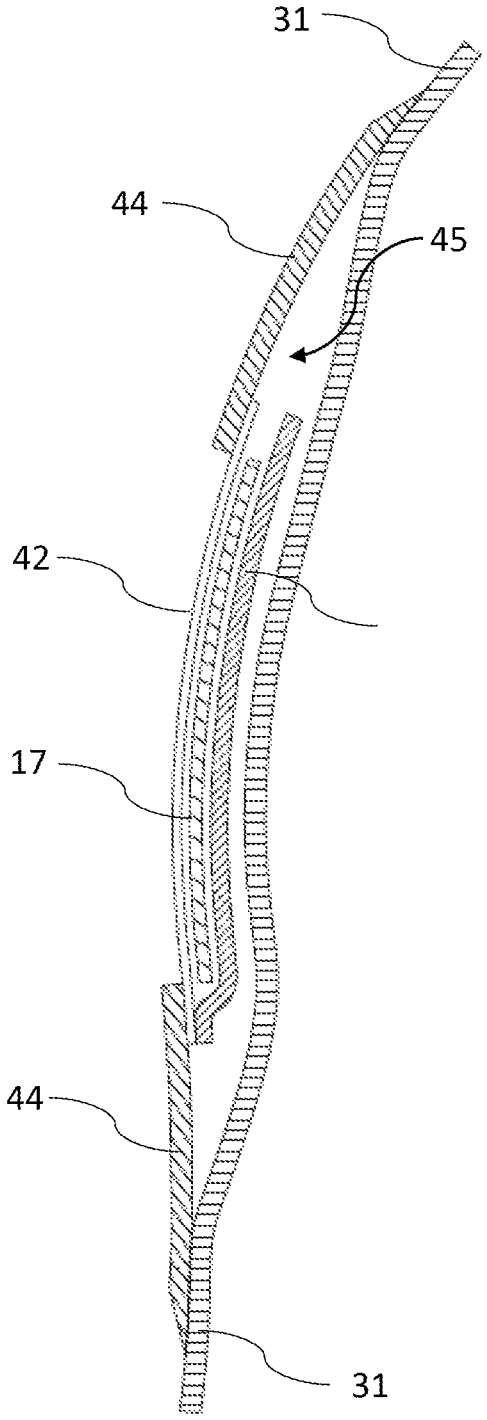
FIG. 15B is a scrap cross-section of a portion of a set of motorcycle racing leathers, fitted with an alternative pocket holding a display screen.

FIGS. 15A and 15B each show a further arrangement for incorporating flexible reflective display screens 17 into modified racing leathers 40. In the arrangement of FIG. 15A, a shallow pocket 43 is formed on an outer surface of a leather panel 31, comprising an optically clear flexible plastics sheet 42, profiled at its edges so as to be faired into a profile of the leather panel 31. An opening (not shown) is provided adjacent one edge of the pocket 43 to provide access to its interior. A flexible reflective display screen 17 can thus readily be inserted into the pocket 43 and plugged into electrical connections within the pocket 43 (not shown for simplicity).

In the arrangement of FIG. 15B, a pocket 45 is formed on an outer surface of a leather panel 31 of the racing leathers 40, in which the pocket 45 is made up of a further sheet of leather 44 sewn to the leather panel 31. The leather sheet 44 has a proportionately large central window aperture, which is filled by a panel of optically clear plastics material (here, an optically clear flexible plastics sheet 42), fixed to an inner face of the leather sheet 44. The leather sheet 44 is thinned adjacent its margins, so as to be faired into a profile of the leather panel 31. An opening (not shown) is provided adjacent one edge of the pocket 43 to provide access to its interior. Within this interior of the pocket 45, an internal pouch 46 of leather or flexible plastics material is located adjacent to and generally co-extensive with the optically clear flexible plastics sheet 43, so that it may receive a flexible reflective display screen 17 and hold it in alignment with the optically clear flexible plastics sheet 42 for maximum visibility. (Electrical connections, not shown for simplicity, are provided within the internal pouch 46, to link the display screen 17 to a remote display controller 25, a power supply, etc)

Thus, in both arrangements, a display screen 17 can rapidly be replaced if necessary, or it can be inserted at the last minute to reduce the risk of damage. They also allow removal of the display screens 17 for cleaning of the leathers 40. It is currently envisaged that these arrangements allowing selective insertion and removal of display screens 17 from the leathers 40 would be particularly suitable for use mounted to the more flexible leather panels 31 of the suit as a whole.

Figure 38:
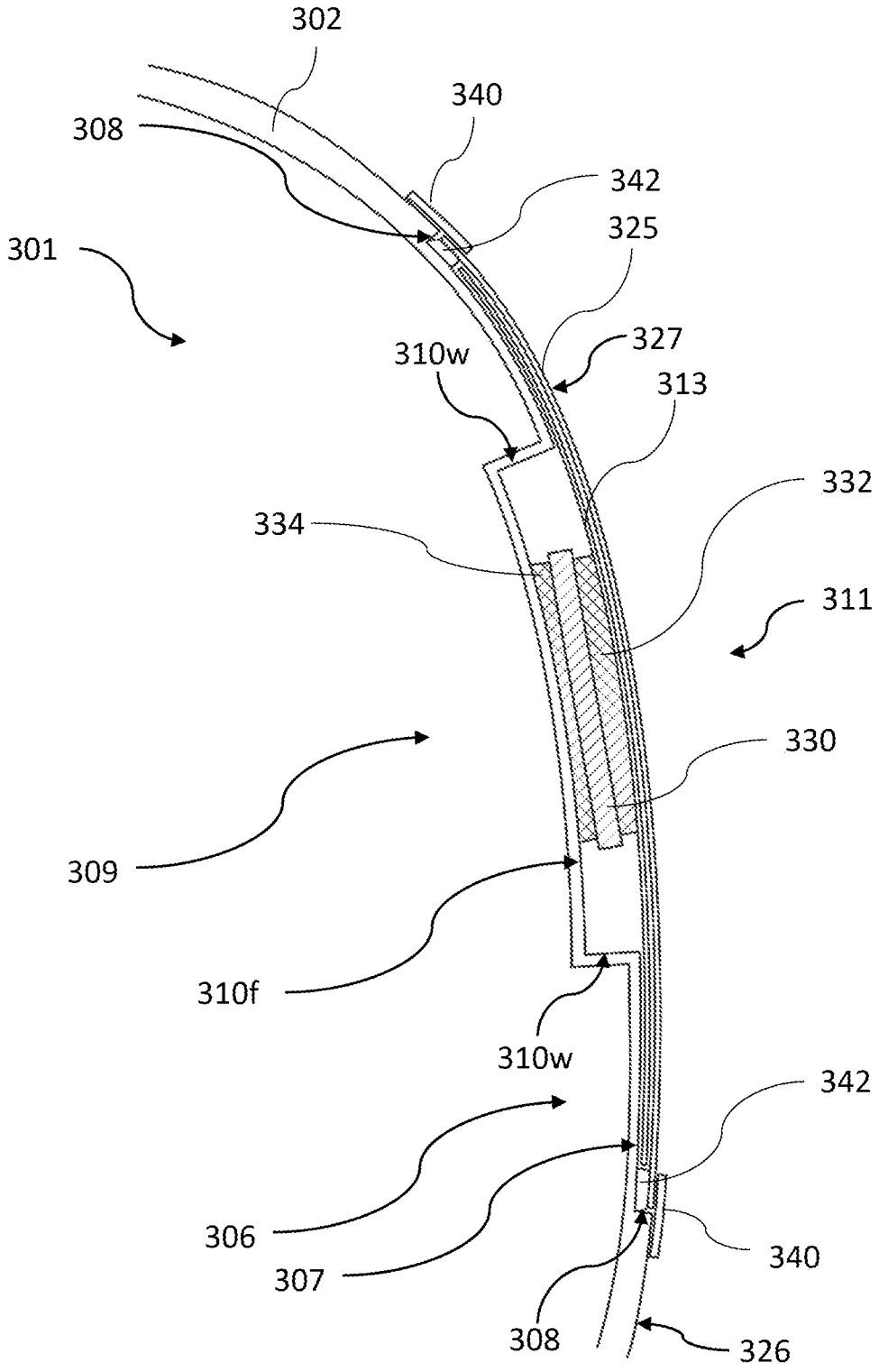
FIG. 38 is a cross section of a bodywork element embodying the present invention with a display screen module mounted to a bodywork panel, the display screen removeably mounted to an installation frame.
Figure 39:
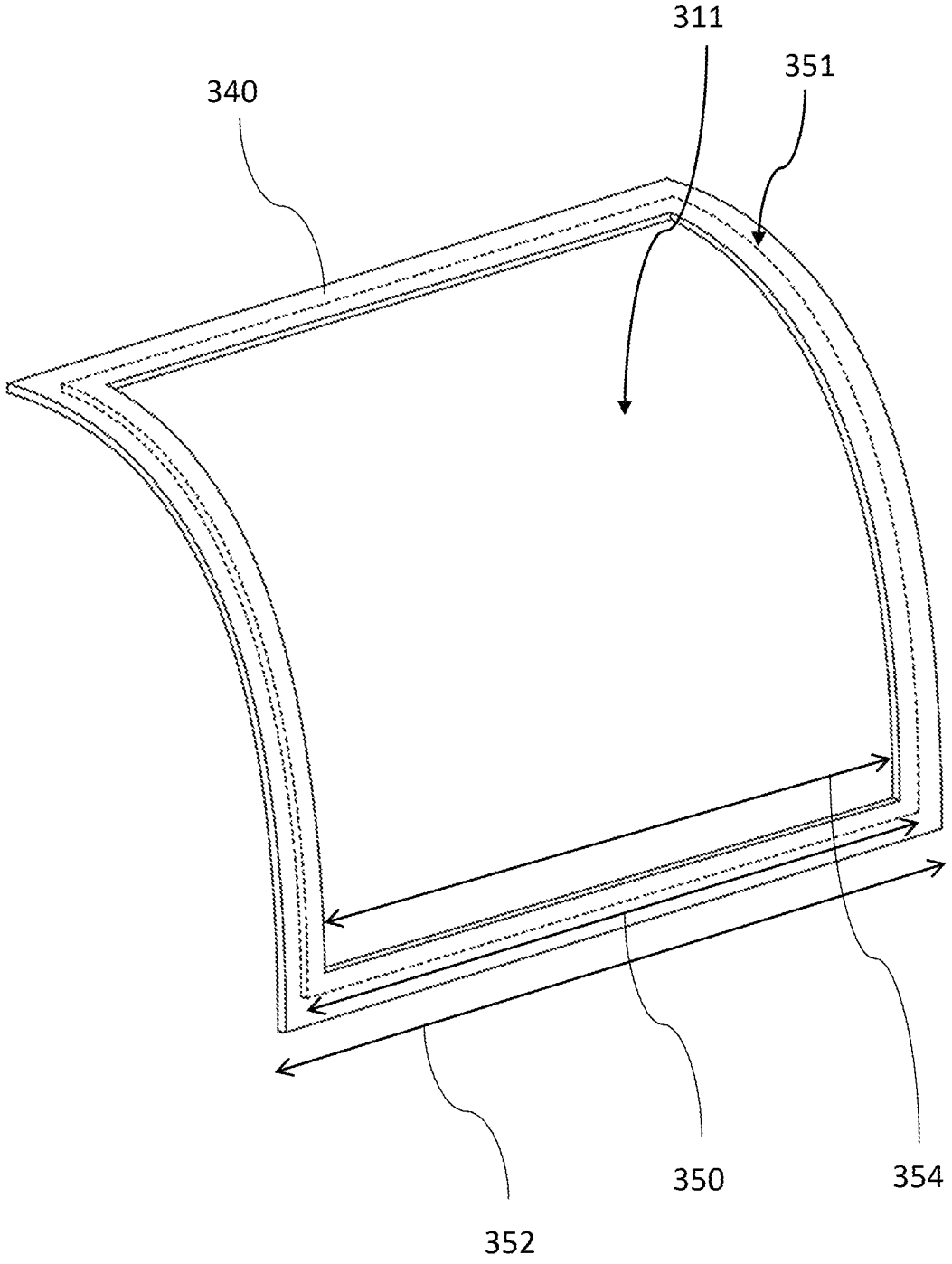
FIG. 39 is a perspective view of the installation frame and display screen module of FIG. 38.

FIGS. 38 and 39 illustrate a further embodiment of a bodywork panel 301 having a display screen module 311, and a technique for manufacturing the bodywork panel 301.

The bodywork panel 301 is constructed from a material 302 chosen according to the type of vehicle the bodywork panel 301 will be installed on. For example, the material 302 may be sheet steel, sheet aluminium, carbon fibre composite material, or a layer of Nomex® positioned between layers of carbon fibre composite material as described in the various embodiments above.

Similar to the embodiments shown in FIGS. 16 to 23, the bodywork panel 301 includes a first recess 306 comprising a floor 307 and walls 308. The recess 306 is configured to receive a display screen module 311 (such as the display screen module 111 described above, for example an e-paper display). The bodywork panel 301 preferably includes a second recess 309 positioned within the first recess 307 and having walls 310*w* and a floor 310*f*.

The display screen module 311 comprises a flexible display screen 313, for example an e-paper display and outer cover 325. Outer cover 325 is at least partially optically clear, and preferably made from a plastics material that is at least partially transparent to visible wavelengths of light. In an example, the outer cover is made of a plastics material of sufficient robustness to provide a degree of protection to the flexible display screen 313 in use. Optionally the outer cover 325 extends beyond a perimeter of the flexible display screen—advantageously this provides a convenient area of the outer cover on which to locate an adhesive 342 (see below).

Preferably the outer cover 325 is shaped such that the outer surface 326 of the bodywork panel 301 and the outer surface 327 of the outer cover 325 together form a predefined aerodynamic profile. For example, the predefined aerodynamic profile may match the profile of an existing bodywork panel that does not employ electronic displays, such that the bodywork panel 301 and display screen module 311 provide the same/similar aerodynamic properties as the existing bodywork panel. The shape of the outer cover 325 is preferably created by vacuum forming a plastics material, however other moulding techniques could alternatively be used.

In this embodiment, the display screen module 311 also includes an electronics module 330. Electronics module 330 may comprise a display controller, a wireless communications electronics, power electronics, and/or any other electronics required to control/operate the flexible display screen 313. The second recess 309 is configured to receive the electronics module 330.

During manufacture, the outer surface (that is, the surface that displays content) of the flexible display screen 313 is affixed to the outer cover 325 (for example by means of an optically clear double-sided adhesive film positioned between the flexible display screen 313 and the outer cover 325). A first support member 332 is affixed to an inside surface (opposing the surface that displays content) of the flexible display screen 313. The first support member 332 is preferably made from a resiliently deformable material, for example foam. The electronics module 330 is also affixed to the first support member 332, such that the first support member 332 is positioned between the electronics module 330 and the flexible display module. A second support member 334 is affixed to the electronics module 330, such that the electronics module 330 is positioned between the first and second support members 332, 334. The second support member 334 is also preferably made from a resiliently deformable material, for example foam.

During manufacture, the outer cover 325 is removeably affixed to an installation frame or jig 340. The installation frame 340 may be flexible and/or shaped to conform to the profile of a perimeter of the display screen module 311 (as shown in FIG. 39). In examples where the shape of the installation frame is pre-formed, it will be appreciated that the shape of the display screen module 311, and thus the shape of the installation frame 340 may depend on the shape of the body panel 301 on which the display screen module 311 is to be installed. In one example, the installation frame 340 is fabricated from a plastics material such as a flexible plastics material that can be flexed (or alternatively moulded) to the desired profile.

Preferably the outer cover 325 is removeably affixed to the installation frame 340 prior to assembly of the other components of the display screen module 311 —advantageously this allows the installation jig 340 to act as a support while assembling the other components of the display screen module 311. Alternatively, the outer cover 325 is removeably affixed to the installation frame 340 after two or more of the other components have been assembled (e.g. after the cover 325 has been affixed to the flexible display screen 313). Optionally the outer cover 325 is removeably affixed to the installation frame 340 using a temporary adhesive, for example using a double-sided adhesive tape between the outer cover 325 and the installation frame 340.

In this embodiment, an adhesive 342 is applied at a position corresponding to the perimeter of the display screen 311. The adhesive 342 may either be applied either: to a perimeter portion of the floor 307 of the first recess 306 (e.g. proximate to the walls 308); to a perimeter portion of an inside surface (a surface facing the floor 307 of the recess 306 in use) of the outer cover 325; or both. Although the adhesive 342 is shown as being positioned around a perimeter of the display screen module (in this case on a perimeter of the outer cover 325), alternatively the adhesive 342 may be positioned at other locations between the first recess 306 (and optionally the second recess 309) and the display screen module 311.

Once the components of the display screen module 311 have been assembled as described above, the outer cover 325 has been removeably attached to the installation frame 340, and the adhesive 342 has been applied, the installation frame 340 is then manoeuvred so as to position the display screen 311 in the first recess 306 (and correspondingly position the electronics module 330 within the second recess 309).

Preferably the installation frame 340, like the display screen 311, is flexible. In this embodiment, when the display screen 311 is brought into contact with the first recess 306 using the installation frame 340, both the installation frame 340 and display screen 311 are caused to flex, such that the display screen 311 conforms to the shape of the first recess and consequently the outer surfaces 313 is conformal with a surface profile of the bodywork panel 301. Alternatively, the installation frame 340 can be pre-formed to a shape that corresponds to the shape of the bodywork panel 301.

In some examples a further external mounting jig (not shown) may be connected to the installation frame 340, and configured to hold the installation frame (and thus the assembled display screen module 311) in place during curing of the adhesive 342. Optionally such an external mounting jig can also be shaped to conform to the contours of the specific display screen module 311 being fitted. Alternatively, a temporary adhesive or other removable attachment means can be provided to temporarily secure the installation frame 340 to the bodywork panel 301 during curing of the adhesive 342.

FIG. 39 shows a perspective view of the installation frame 340. The outer edges of the display screen module 311 (behind the installation frame 340 from as viewed in FIG. 39) are indicated by broken lines 351. Preferably the installation frame is configured to have outside dimensions 352 greater than corresponding outside dimensions 350 of the display screen module 311 (e.g., as shown in FIG. 38, greater than outside dimensions of the outer cover 325), and an inner cutout with inside dimensions 354 less than corresponding outside dimensions 350 of the display module (these relative dimensions apply for each edge of the display screen module 311; the dimensions are shown with respect to only one edge in FIG. 39 for ease of illustration). Thus the frame 340 bridges the marginal edges of the display screen module 311.

In an example, the adhesive 342 is a UV curable adhesive, and the means for removeably affixing the outer cover 325 to the installation frame 340 is at least partially transparent to UV radiation (for example double-sided adhesive tape). In this case, following positioning of the display screen module 311 within the first recess 306, the adhesive 342 is subjected to UV radiation through the outer cover 325 until cured. In this example, the mounting frame 340 optionally includes one or more UV light sources (for example a series of UV LEDs), configured to provide UV radiation to cure the UV adhesive 342.

In the arrangement shown in FIG. 38, preferably the depth of the perimeter of the first rebate 306 is equal to the thickness of the outer cover 325, plus a small amount to account for the thickness of the adhesive 342. Advantageously this allows the surface of the outer cover 325 to lie flush with the outer surface of the bodywork panel 301.

After the adhesive 342 has cured, the installation frame 340 is then removed from the outer cover 325. Any join line between the bodywork panel 301 and the now installed display screen module 311 is preferably then filled using a suitable filler material. The filler material is then smoothed.

Advantageously, use of the installation frame 340 increases the speed with which the bodywork panel 301 and corresponding display screen module 311 can be accurately assembled, while ensuring that the outer cover 325 is flush and in line with the contours of the surrounding bodywork panel 301.

In the arrangement shown in FIG. 38, once the display screen module has been installed, the first and second supports 332, 334 support the electronics module, and optionally at to absorb at least some of the vibrations experienced by the bodywork panel 310 during operation of the vehicle, thereby reducing the vibrations experienced by the electronics module 330.

While the embodiment shown in FIG. 38 includes a single second recess 309, it will be appreciated that two or more second recesses, or no second recess, may be provided, depending on the physical dimensions of the electronics module 330. Preferably the shape of the first recess and the number and shape of second recesses determined to reduce the amount of empty space between the bodywork panel 301 and the display screen module 311. This in turn reduces the volume of space that the recesses 306, 309 collectively occupy within the body of the vehicle, thus maximising the volume available for other systems and components within the body of the vehicle.

It is noted that the features described in relation to FIGS. 38 and 39 are envisaged for combination with the features described in relation to FIGS. 16 to 37.

Whilst the invention has been described with reference to the foregoing specific embodiments, the invention is not limited by the described embodiments. The scope of protection is defined by the appended claims.

The invention claimed is:

1. A bodywork element for a vehicle, adapted for the external display of controllably selectable images, comprising:

a bodywork panel having a body portion and a shallow recess formed within the body portion, the shallow recess comprising a floor and walls, and the bodywork panel having an outer surface extending beyond the shallow recess, the floor of said recess substantially matching a profile of the outer surface of the bodywork panel, and a display screen module comprising flexible reflective display screen mounted beneath a first layer of optically clear plastics material so as to be visible through said first layer, wherein the display screen module is held conformably within the shallow recess with the first layer of optically clear plastics material extending flush with the outer surface of the bodywork panel and continuing a surface profile of the bodywork panel, and wherein the reflective display screen is operatively connected or connectable to a controller therefor, said controller being adapted to control the reflective display screen to display a selected image.

2. The bodywork element of claim 1, wherein the flexible reflective display screen means comprises an electronic reflective display screen.

3. The bodywork element of claim 1, wherein the display screen module is removably held within the shallow recess of the bodywork panel.

4. The bodywork element of claim 3:

wherein the flexible reflective display screen is mounted between the first layer and a second layer of protective plastics material, the second layer of protective plastics material extending in contact with the floor of the recess; and wherein the display screen module is held within said shallow recess by a non-permanent adhesive, extending between the second layer of the display screen module and the floor of the shallow recess.

5. The bodywork element of claim 1:

wherein the flexible reflective display screen is mounted between the first layer and a second layer of protective plastics material, the second layer of protective plastics material extending in contact with the floor of the recess;

wherein the display screen module has a plurality of edges, and wherein the display screen module is provided with seal means extending along each of the plurality of edges, between the first layer of optically-clear plastics material and the second layer of protective plastics material, so as to enclose protectively the flexible reflective display screen on all sides.

6. The bodywork element of claim 1, wherein a circumferential profile of the display screen module conforms substantially to a profile of the shallow recess of the bodywork panel.

7. The bodywork element of claim 1, wherein the display screen module forms an interference fit within the shallow recess.

8. The bodywork element of claim 1, comprising a space between respective edges of the display screen module and the shallow recess, wherein the space is filled flush with adjacent bodywork using removable filler material.

9. The bodywork element of claim 1, wherein the flexible reflective display screen is mounted between the first layer and a second layer of protective plastics material, the second layer of protective plastics material extending in contact with the floor of the recess;

the bodywork element comprising cooperating formations provided within the shallow recess and on at least one of a plurality of edges and the second layer of the display screen module, so as to facilitate location of the display screen module within the shallow recess.

10. The bodywork element of claim 1, comprising a volume defined between an inner surface of the first layer of optically clear plastics material and an adjacent display surface of the flexible reflective display screen, wherein the volume is filled with an optically clear solid, liquid or gel material.

11. The bodywork element of claim 1, wherein the control means is mounted to the bodywork panel.

12. The bodywork element of claim 11, wherein the control means is mounted to an internal, in use, face of the bodywork panel, opposite to a face on which the display screen is visible.

13. The bodywork element of claim 1, wherein the control means is wirelessly operatively connectable to remote server means, by which at least one of image data and display instructions for the display screen module may be passed to the control means.

14. The bodywork element of claim 1, wherein the control means are provided with sensor means or linked to sensor means of the vehicle, so as to receive data including vehicle speed and location, and the control means is programmable to change between displayed images in response to said data.

15. The bodywork element of claim 1, wherein the bodywork element is mountable to a vehicle comprising a racing car.

16. The bodywork element of claim 1, wherein an outer face of the display screen module is provided with a surface texture, wherein either:

said surface texture is embossed on to an outer face of the first layer of optically clear plastics material; or a clear plastics film having said surface texture embossed into one surface is applied to extend across an outer face of the first layer of optically clear plastics material.

17. The bodywork element of claim 1, comprising a cover sheet of plastics film extending across an outer face of a display screen module and across adjacent portions of the bodywork panel, said adjacent portions being to at least one side of the display screen module.

18. The bodywork element of claim 17, wherein the cover sheet comprises:

a clear zone aligned with the display screen module;

at least one coloured zone extending across a join between the display screen module and the bodywork panel; and a transitional zone, disposed between the clear zone and the at least one coloured zone, the transitional zone comprising an opacity gradient extending across the transitional zone.

19. A racing car comprising the bodywork element of claim 1.

20. A method for producing a bodywork element for a vehicle, adapted for the external display of controllably changeable images, comprising the steps of:

providing a bodywork panel having a body portion and a shallow recess formed within the body portion, the shallow recess comprising a floor and walls, the bodywork panel having an outer surface extending beyond the shallow recess;

providing a display screen module comprising flexible reflective display screen mounted beneath a first layer of optically clear plastics material so as to be visible through said first layer;

fitting the display screen module into the shallow recess, the display screen module being shaped to be received into the shallow recess with its first layer continuing a surface profile of the bodywork panel; and arranging an operative connection between the flexible reflective display screen of the display screen module and controller therefor, said controller being adapted to control the display screen module to display a selected image.

* * * * *